US010968739B1

(12) United States Patent
Sollami

(10) Patent No.: US 10,968,739 B1
(45) Date of Patent: Apr. 6, 2021

(54) DIAMOND TIPPED UNITARY HOLDER/BIT

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 16/138,757

(22) Filed: Sep. 21, 2018

Related U.S. Application Data

(63) Continuation-in-part of application No. 15/879,078, filed on Jan. 24, 2018, now Pat. No. 10,415,386, which is a continuation of application No. 14/487,493, filed on Sep. 16, 2014, now Pat. No. 9,909,416, application No. 16/138,757, which is a continuation-in-part of application No. 15/062,620, filed on Mar. 7, 2016, and a continuation-in-part of application No. 15/960,728, filed on Apr. 24, 2018, and a continuation-in-part of application No. 16/038,416, filed on Jul. 18, 2018, and a continuation-in-part of application No. 14/690,679, filed on Apr. 20, 2015, now Pat. No. 10,370,966, and a continuation-in-part of application No. 15/425,086, filed on Feb. 6, 2017, now Pat. No. 10,577,931, and a continuation-in-part of application No. 15/923,051, filed on Mar. 16, 2018, which is a continuation-in-part of application No. 14/676,364, filed on Apr. 1, 2015, now Pat. No. 9,976,418.

(60) Provisional application No. 61/974,064, filed on Apr. 2, 2014, provisional application No. 61/879,353, filed on Sep. 18, 2013, provisional application No. 61/983,291, filed on Apr. 23, 2014, provisional application No. 62/304,169, filed on Mar. 5, 2016.

(51) Int. Cl.
*E21C 35/18* (2006.01)
*E21B 7/00* (2006.01)

(52) U.S. Cl.
CPC ..... *E21C 35/18* (2013.01); *E21B 7/00* (2013.01); *E21C 2035/1803* (2013.01)

(58) Field of Classification Search
CPC ..... E21C 35/18
See application file for complete search history.

(56) References Cited

U.S. PATENT DOCUMENTS

| | | | |
|---|---|---|---|
| 2,382,947 | A | 7/1944 | Brozek |
| 2,810,567 | A | 10/1957 | Kirkham |
| 3,342,531 | A | 9/1967 | Krekeler |
| 3,342,532 | A | 9/1967 | Krekeler |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — Janine M Kreck
(74) *Attorney, Agent, or Firm* — Mercedes V. O'Connor; Rockman Videbeck & O'Connor

(57) ABSTRACT

A unitary bit/holder assembly includes a bit tip insert having a diamond coated tip mounted thereon that is received in a transition member that is brazed onto a forward end of a bit holder. The forward end of the bit holder includes a trough onto which the transition member is mounted. The unitary bit/holder includes a standard length shank or a shortened length shank that can each be mounted into a shortened base block.

12 Claims, 24 Drawing Sheets

(56) References Cited

U.S. PATENT DOCUMENTS 3,397,012 A 8/1968 Krekeler
3,476,438 A 11/1969 Bower, Jr.
3,519,309 A 7/1970 Engle
3,833,264 A 9/1974 Elders
3,833,265 A 9/1974 Elders
3,865,437 A * 2/1975 Crosby ..... E21C 35/197 299/107
4,084,856 A 4/1978 Emmerich
4,247,150 A 1/1981 Wrulich et al.
RE30,807 E 12/1981 Elders
4,310,939 A 1/1982 Iijima
4,453,775 A 6/1984 Clemmow
4,478,298 A 10/1984 Hake
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,632,463 A 12/1986 Sterwerf, Jr.
4,694,918 A 9/1987 Hall
4,702,525 A 10/1987 Sollami
4,763,956 A 8/1988 Emmerich
4,811,801 A 3/1989 Salesky
4,818,027 A 4/1989 Simon
4,821,819 A 4/1989 Whysong
4,844,550 A 7/1989 Beebe
4,915,455 A 4/1990 O'Neill
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,484,191 A 1/1996 Sollami
5,492,188 A 2/1996 Smith et al.
5,551,760 A 9/1996 Sollami
5,607,206 A 3/1997 Siddle
5,628,549 A 5/1997 Ritchey
5,720,528 A 2/1998 Ritchey
5,725,283 A 3/1998 O'Neill
5,823,632 A 10/1998 Burkett
5,924,501 A 7/1999 Tibbitts
5,931,542 A 8/1999 Britzke
5,934,854 A 8/1999 Krautkremer et al.
5,992,405 A 11/1999 Sollami
D420,013 S 2/2000 Warren
6,019,434 A 2/2000 Emmerich
6,102,486 A 8/2000 Briese
6,176,552 B1 1/2001 Topka, Jr.
6,196,340 B1 3/2001 Jensen et al.
6,199,451 B1 3/2001 Sollami
6,250,535 B1 * 6/2001 Sollami ..... B23K 1/0008 228/132
6,331,035 B1 12/2001 Montgomery, Jr.
6,341,823 B1 1/2002 Sollami
6,357,832 B1 3/2002 Sollami
6,371,567 B1 4/2002 Sollami
6,382,733 B1 5/2002 Parrott
6,428,110 B1 8/2002 Ritchey et al.
6,508,516 B1 1/2003 Kammerer
D471,211 S 3/2003 Sollami
6,585,326 B2 7/2003 Sollami
6,685,273 B1 * 2/2004 Sollami ..... B28D 1/188 299/102
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffer
6,846,045 B2 * 1/2005 Sollami ..... B28D 1/188 299/105
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 * 10/2009 Sollami ..... E21C 35/197 144/241
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,660 B2 8/2011 Monyak et al.
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall

(56) References Cited

U.S. PATENT DOCUMENTS

| | | | |
|---|---|---|---|
| 8,215,420 | B2 | 7/2012 | Hall |
| 8,292,372 | B2 | 10/2012 | Hall |
| 8,414,085 | B2 | 4/2013 | Hall |
| 8,449,039 | B2 | 5/2013 | Hall |
| 8,485,609 | B2 | 7/2013 | Hall |
| 8,500,209 | B2 | 8/2013 | Hall |
| 8,540,320 | B2 | 9/2013 | Sollami |
| RE44,690 | E | 1/2014 | Sollami |
| 8,622,482 | B2 | 1/2014 | Sollami |
| 8,622,483 | B2 | 1/2014 | Sollami |
| 8,646,848 | B2 | 2/2014 | Hall |
| 8,728,382 | B2 | 5/2014 | Hall |
| 8,740,314 | B2 | 6/2014 | O'Neill |
| 9,004,610 | B2 | 4/2015 | Erdmann et al. |
| 9,028,008 | B1 | 5/2015 | Bookhamer |
| 9,039,099 | B2 | 5/2015 | Sollami |
| 9,316,061 | B2 | 4/2016 | Hall |
| 9,518,464 | B2 | 12/2016 | Sollami |
| 9,879,531 | B2 | 1/2018 | Sollami |
| 9,909,416 | B1 | 3/2018 | Sollami |
| 9,976,418 | B2 | 5/2018 | Sollami |
| 9,988,903 | B2 | 6/2018 | Sollami |
| 10,072,501 | B2 | 9/2018 | Sollami |
| 10,105,870 | B1 | 10/2018 | Sollami |
| 10,107,097 | B1 | 10/2018 | Sollami |
| 10,107,098 | B2 | 10/2018 | Sollami |
| 10,180,065 | B1 | 1/2019 | Sollami |
| 10,260,342 | B1 | 4/2019 | Sollami |
| 10,323,515 | B1 | 6/2019 | Sollami |
| 10,337,324 | B2 | 7/2019 | Sollami |
| 10,370,966 | B1 | 8/2019 | Sollami |
| 10,385,689 | B1 | 8/2019 | Sollami |
| 10,415,386 | B1 | 9/2019 | Sollami |
| 10,502,056 | B2 | 12/2019 | Sollami |
| 2002/0063467 | A1 | 5/2002 | Taitt |
| 2002/0074850 | A1 | 6/2002 | Montgomery, Jr. |
| 2002/0074851 | A1 | 6/2002 | Montgomery, Jr. |
| 2002/0109395 | A1 | 8/2002 | Sollami |
| 2002/0167216 | A1 | 11/2002 | Sollami |
| 2002/0192025 | A1 | 12/2002 | Johnson |
| 2003/0015907 | A1 | 1/2003 | Sollami |
| 2003/0047985 | A1 | 3/2003 | Stiffler |
| 2003/0052530 | A1 | 3/2003 | Sollami |
| 2003/0122414 | A1* | 7/2003 | Sollami ..... B28D 1/188 299/113 |
| 2003/0209366 | A1 | 11/2003 | McAlvain |
| 2004/0004389 | A1 | 1/2004 | Latham |
| 2004/0174065 | A1 | 9/2004 | Sollami |
| 2005/0212345 | A1 | 9/2005 | Sleep et al. |
| 2006/0071538 | A1 | 4/2006 | Sollami |
| 2006/0186724 | A1 | 8/2006 | Stehney |
| 2006/0261663 | A1 | 11/2006 | Sollami |
| 2007/0013224 | A1 | 1/2007 | Stehney |
| 2007/0040442 | A1 | 2/2007 | Weaver |
| 2007/0052279 | A1 | 3/2007 | Sollami |
| 2008/0035386 | A1 | 2/2008 | Hall et al. |
| 2008/0036276 | A1 | 2/2008 | Hall et al. |
| 2008/0036283 | A1 | 2/2008 | Hall et al. |
| 2008/0100124 | A1 | 5/2008 | Hall et al. |
| 2008/0145686 | A1 | 6/2008 | Mirchandani |
| 2008/0164747 | A1 | 7/2008 | Weaver et al. |
| 2008/0284234 | A1 | 11/2008 | Hall et al. |
| 2009/0146491 | A1 | 6/2009 | Fader et al. |
| 2009/0160238 | A1 | 6/2009 | Hall et al. |
| 2009/0256413 | A1 | 10/2009 | Majagi |
| 2009/0261646 | A1 | 10/2009 | Ritchie et al. |
| 2010/0045094 | A1 | 2/2010 | Sollami |
| 2010/0244545 | A1 | 9/2010 | Hall |
| 2010/0253130 | A1 | 10/2010 | Sollami |
| 2010/0320003 | A1 | 12/2010 | Sollami |
| 2010/0320829 | A1 | 12/2010 | Sollami |
| 2011/0006588 | A1 | 1/2011 | Monyak et al. |
| 2011/0089747 | A1 | 4/2011 | Helsel |
| 2011/0175430 | A1 | 7/2011 | Heiderich et al. |
| 2011/0204703 | A1 | 8/2011 | Sollami |
| 2011/0254350 | A1 | 10/2011 | Hall |
| 2012/0001475 | A1 | 1/2012 | Dubay et al. |
| 2012/0027514 | A1 | 2/2012 | Hall |
| 2012/0056465 | A1 | 3/2012 | Gerer et al. |
| 2012/0068527 | A1 | 3/2012 | Erdmann |
| 2012/0104830 | A1 | 5/2012 | Monyak et al. |
| 2012/0181845 | A1 | 7/2012 | Sollami |
| 2012/0242136 | A1 | 9/2012 | Ojanen |
| 2012/0248663 | A1 | 10/2012 | Hall |
| 2012/0261977 | A1 | 10/2012 | Hall |
| 2012/0280559 | A1 | 11/2012 | Watson |
| 2012/0286559 | A1 | 11/2012 | Sollami |
| 2012/0319454 | A1 | 12/2012 | Swope |
| 2013/0169023 | A1 | 7/2013 | Monyak |
| 2013/0181501 | A1 | 7/2013 | Hall et al. |
| 2013/0199693 | A1 | 8/2013 | Tank et al. |
| 2013/0307316 | A1 | 11/2013 | Roetsch et al. |
| 2014/0035346 | A1 | 2/2014 | Fundakowski et al. |
| 2014/0110991 | A1 | 4/2014 | Sollami |
| 2014/0232172 | A1 | 8/2014 | Roth et al. |
| 2014/0262541 | A1 | 9/2014 | Parsana et al. |
| 2014/0326516 | A1 | 11/2014 | Haugvaldstad |
| 2015/0028656 | A1 | 1/2015 | Sollami |
| 2015/0035343 | A1 | 2/2015 | Ojanen |
| 2015/0137579 | A1 | 5/2015 | Lachmann et al. |
| 2015/0198040 | A1 | 7/2015 | Voitic et al. |
| 2015/0240634 | A1 | 8/2015 | Sollami |
| 2015/0285074 | A1 | 10/2015 | Sollami |
| 2015/0292325 | A1 | 10/2015 | Sollami |
| 2015/0300166 | A1 | 10/2015 | Ries et al. |
| 2015/0308488 | A1 | 10/2015 | Kahl |
| 2015/0315910 | A1 | 11/2015 | Sollami |
| 2015/0354285 | A1 | 12/2015 | Hall |
| 2016/0102550 | A1 | 4/2016 | Paros et al. |
| 2016/0194956 | A1 | 7/2016 | Sollami |
| 2016/0229084 | A1 | 8/2016 | Lehnert |
| 2016/0237818 | A1 | 8/2016 | Weber et al. |
| 2017/0089198 | A1 | 3/2017 | Sollami |
| 2017/0101867 | A1 | 4/2017 | Hall et al. |

FOREIGN PATENT DOCUMENTS

| | | |
|---|---|---|
| DE | 202012100353 | 6/2013 |
| DE | 102015121953 | 7/2016 |
| DE | 102016118658 | 3/2017 |
| EP | 3214261 | 9/2017 |
| GB | 1114156 | 5/1968 |
| GB | 1218308 | 1/1971 |
| GB | 2483157 | 2/2012 |
| GB | 2534370 | 7/2016 |
| WO | 2008105915 A2 | 9/2008 |
| WO | 2008105915 A3 | 9/2008 |
| WO | 2009006612 | 1/2009 |

* cited by examiner

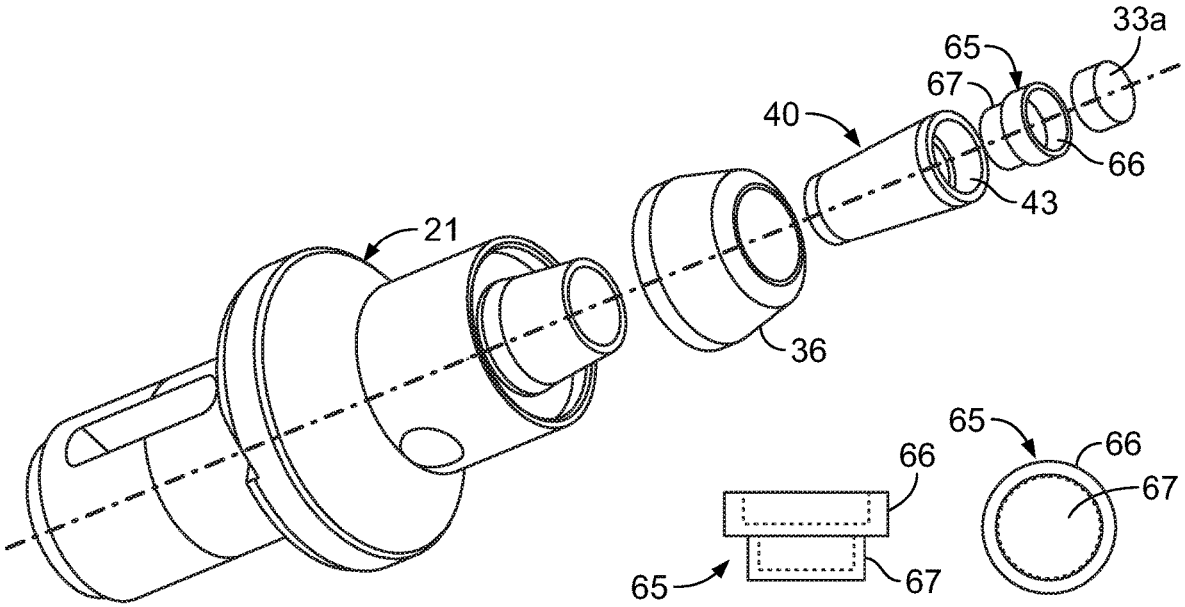
FIG. 6 FIG. 6A FIG. 6B
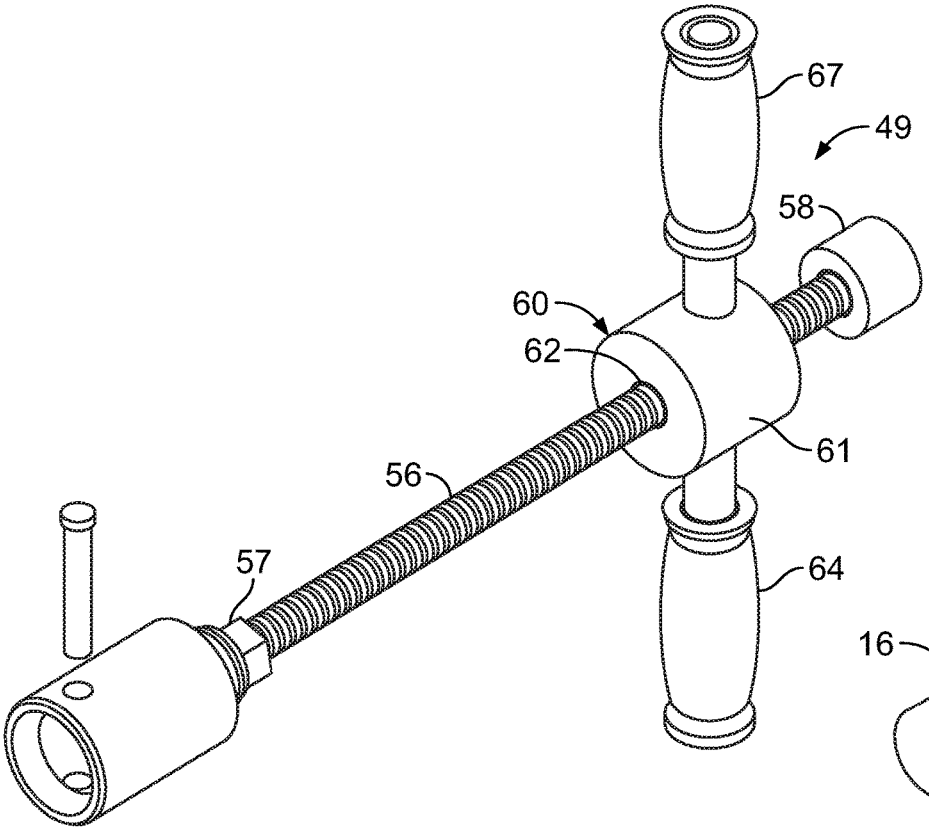
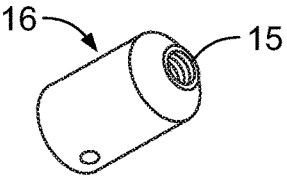
FIG. 7 FIG. 8

DIAMOND TIPPED UNITARY HOLDER/BIT

CROSS-REFERENCE TO RELATED APPLICATION(S)

This application claims priority to and is a continuation-in-part of U.S. Non-provisional application Ser. No. 15/879,078, filed Jan. 24, 2018, U.S. Non-provisional application Ser. No. 15/879,078 claims priority to and is a continuation of U.S. Non-provisional application Ser. No. 14/487,493, filed Sep. 16, 2014, now U.S. Pat. No. 9,909,416, issued Mar. 6, 2018, and U.S. Non-provisional application Ser. No. 14/487,493 claims priority to U.S. Provisional Application No. 61/879,353, filed Sep. 18, 2013; this application claims priority to and is a continuation-in-part of U.S. Non-provisional application Ser. No. 16/038,416, filed Jul. 18, 2018; this application claims priority to and is a continuation-in-part of U.S. Non-provisional application Ser. No. 14/690,679, filed Apr. 20, 2015, and U.S. Non-provisional application Ser. No. 14/690,679 claims priority to U.S. Provisional Application No. 61/983,291, filed Apr. 23, 2014; this application claims priority to is a continuation-in-part of U.S. Non-provisional application Ser. No. 15/425,086, filed Feb. 6, 2017, and U.S. Non-provisional application Ser. No. 15/425,086 claims priority to U.S. Provisional Application No. 62/304,169, filed Mar. 5, 2016; this application claims priority to and is a continuation-in-part of U.S. Non-provisional application Ser. No. 15/923,051, filed Mar. 16, 2018, U.S. Non-provisional application Ser. No. 15/923,051 claims priority to and is a continuation-in-part of U.S. Non-provisional application Ser. No. 14/676,364, filed Apr. 1, 2015, now U.S. Pat. No. 9,976,418, issued May 22, 2018, and U.S. Non-provisional application Ser. No. 14/676,364 claims priority to U.S. Provisional Application No. 61/974,064, filed Apr. 2, 2014; this application claims priority to and is a continuation-in-part of U.S. Non-provisional application Ser. No. 15/062,620, filed Mar. 7, 2016 and this application claims priority to and is a continuation-in-part of U.S. Non-provisional application Ser. No. 15/960,728, filed Apr. 24, 2018; to the extent allowed by law and the contents of which are incorporated herein by reference in their entireties.

TECHNICAL FIELD

This disclosure relates to combination bit/holders used in road milling, mining and trenching and, more particularly, to diamond coated tungsten carbide inserts and structure for mounting them as part of a unitary bit/holder combination.

BACKGROUND

Road milling bits and bit holders, the design of which, when made in differing sizes, can also be used for trenching machines and mining machines, have benefited greatly from what has been termed a quick change shank, found in the instant inventor's prior U.S. Pat. Nos. 6,371,567, 6,685,273, and 7,883,155. Additionally, the construction features of the forward end of the advanced bit design found in Applicant's U.S. Pat. No. 6,739,327 has been cited in over 70 later issued patents. U.S. Pat. No. 5,161,627 to Burkett disclosed that one could mount a diamond coated insert in a one-piece bit/bit holder body. A similar structure with a diamond coated tip is found in U.S. Pat. No. 4,944,559 to Sionett. These diamond coatings have heretofore been formed in a standard process that includes high temperature, high pressure forming of same on a tungsten carbide high impact substrate.

A later version of the present Applicant's prior invention of a quick change shank such as found in U.S. Pat. No. 6,371,567 is provided in combination with a diamond tip and found at U.S. Pat. No. 8,118,371 to Hall et al.

With diamond coated tips of road milling machinery, it has been found that the working life of the tip has been greatly increased. As such, it is no longer necessary to provide changeable bits in bit holders. The operating life of bits and bit holders are such that they can be physically combined in a unitary structure.

A need has developed for a lower cost combination diamond coated tip and front portion, formerly used on a removable bit, with a quick change bit holder and improvements in tools for inserting and removing same in their working mountings.

SUMMARY

This disclosure relates generally to bit assemblies for road milling, mining, and in particular trenching equipment. One implementation of the teachings herein is a tool that includes a body comprising a recess axially extending inwardly from a forward end of the body; a shank extending axially from a bottom of the body; and a transition member comprising a bore axially extending from a top of the transition member to a bore termination adjacent a distal end of the transition member, the distal end of the transition member adapted to be seated and brazed in the recess of the body.

In another implementation of the teachings herein is a tool that includes a body comprising an annular recess axially extending inwardly from a forward end of the body and a forward extension axially extending outwardly from the annular recess; a shank extending axially from a bottom of the body; and a transition member comprising a bore axially extending from a top of the transition member to a distal end of the transmission member, the forward extension extending partially through the bore, and the distal end of the transmission member adapted to be seated and brazed in the recess of the body.

In yet another implementation of the teaching herein is a bit tip insert that includes a body comprising a tip portion and a base portion subjacent the tip portion, the tip portion comprising a tip diameter that is less than a base diameter of the base portion; and an overlay on an outer surface of the tip portion.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to scale. On the contrary, the dimensions of the various features are arbitrarily expanded or reduced for clarity.

FIG. 6 is an exploded perspective view of a first modification of the first embodiment of the combination diamond coated bit/holder, shown in FIGS. 1-5, further including an added steel cup into which the tungsten carbide diamond coated tip is inserted which, in turn, is inserted in the forward end of the reverse taper tungsten carbide insert in accordance with implementations of this disclosure;

FIG. 6*a* is an elevational view of the tip receiving cup including the bottom pad shown in FIG. 6 in accordance with implementations of this disclosure;

FIG. 6*b* is a top plan view of the cup shown in FIG. 6 in accordance with implementations of this disclosure;

FIG. 7 is a top ¼ perspective view of a complete bit/holder removal tool for removing the bit/holder from a bit block in accordance with implementations of this disclosure;

FIG. 8 is a top ¾ perspective view of the female cup of the bit/holder removal tool showing the Acme threaded top bore therein in accordance with implementations of this disclosure;

DETAILED DESCRIPTION

Figure 1:
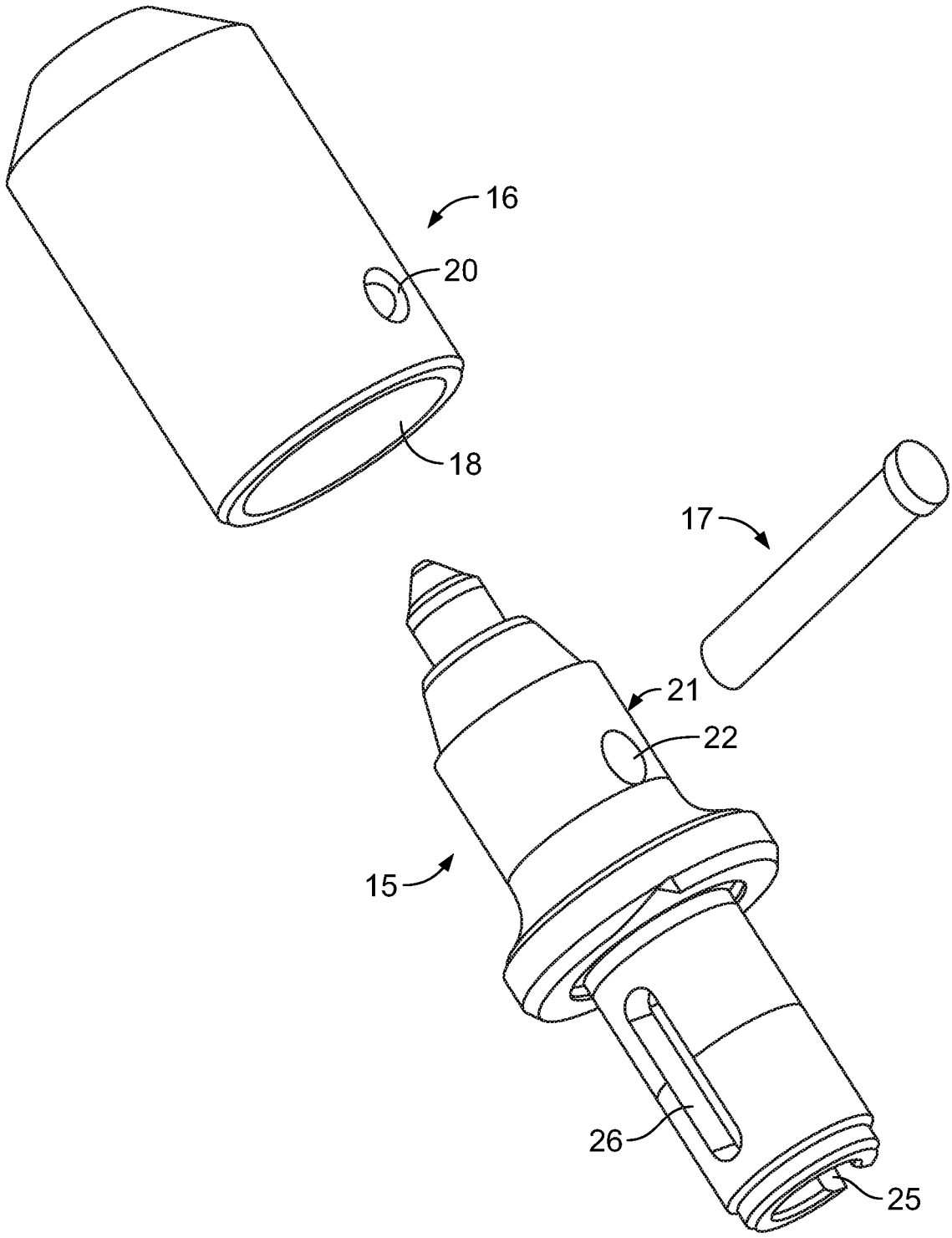
FIG. 1 is an exploded perspective view of a first embodiment of a combination diamond coated bit/bit holder together with a drift pin and cup portion of a tool useful for inserting the bit holder in its bit block (not shown) in accordance with implementations of this disclosure.

Referring to FIG. 1, a first embodiment of a combined diamond coated bit/holder is shown, generally at 15, in its completed form together with a female cup insertion-removal member 16 and its accompanying drift pin 17, which extends through the hollow open bottom 18 of the female cup member through aperture 20 and through a body 21 of the combined bit/holder at bore 22 for insertion into a bit block (not shown) which, in turn, is mounted on a rotatable drum (not shown).

Figure 2:
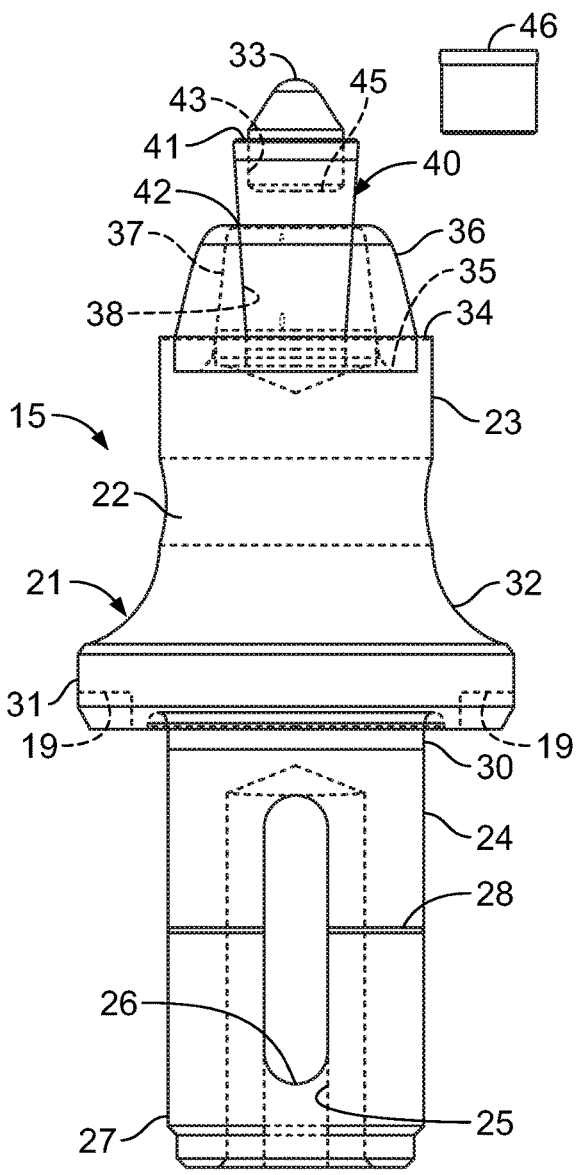
FIG. 2 is a front elevational view of the first embodiment of the combination diamond coated tip bit/bit holder of the present disclosure shown in FIG. 1 together with two alternate shape diamond coated tip inserts in accordance with implementations of this disclosure.
Figure 3:
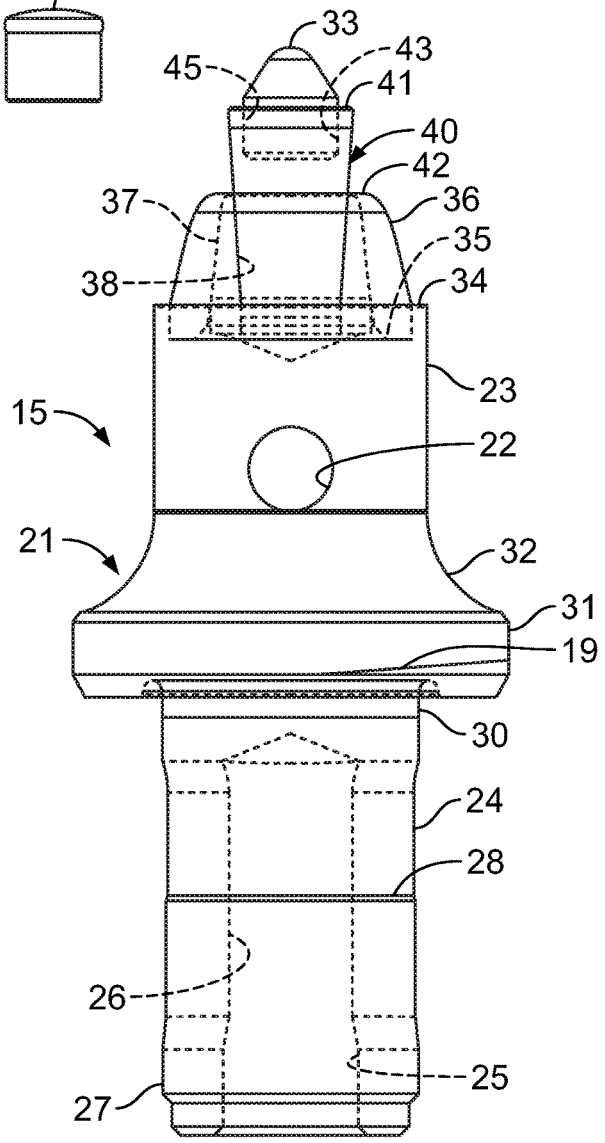
FIG. 3 is a side elevational view of the first embodiment of the combination diamond coated tip/bit holder shown in FIG. 2 in accordance with implementations of this disclosure.

Referring to FIGS. 1-3, the first embodiment of the combination diamond coated bit/holder 15 includes the body 21 having an upper body portion 23 and a lower shank portion 24. The upper and lower shank portion are both made of 4140, 4340, or similar steel. The lower shank portion 24 is a hollow, generally cylindrical member having at least one slot 25 extending axially through the side of the hollow shank from the distal end upwardly toward the top of the shank portion. Alternately, a second, wholly internal slot 26, may be positioned preferably 180 degrees around the shank from the first slot extending in an axial direction similar to the first slot 25, however, starting from a position in spatial relation upwardly from the bottom distal end of the shank as shown at 26 in FIG. 2.

In the first embodiment of the combination diamond coated bit/holder 15, the shank 24 includes a lower resilient bit block bore engaging portion 27, and a millable shank portion 28 which may in this embodiment be a few thousandths of an inch. An uppermost part 30 of the shank 24 immediately adjacent the larger body portion 21 includes a generally cylindrical portion having an annular outer surface sized to be press fit into the top of the bit block bore (not shown). As noted previously in U.S. Pat. Nos. 7,883,155, 6,685,273, and 6,371,567, the interference fit between the bottom shank portion 27 and a bit holder bore is substantially larger than a standard interference fit (0.001-0.003) for a solid shank, extending approximately 0.012 to 0.030 inches for a nominal 1½ inch diameter shank for use in road milling.

The upper or body portion 21 of the holder 15 includes a radially extending annular flange 31 defining the bottom of what is termed in the industry as a tire portion, diametrically the widest segment of a holder (about 2⅝ inch for a road milling holder). The height of the tire portion may approximate ½ inch and includes a pair of opposing wedge shape cutouts 19-19. From the top of the tire portion, the body generally slopes radially inwardly at 32 and upwardly to perform a ramp-like function with the aim of moving material, macadam, concrete, etc. outwardly from the forward tip of the diamond covered leading portion 33 of the bit/holder. In this illustrated embodiment, the mid section of the upper body portion 23 of the bit/holder 15 includes a generally cylindrical segment having at the bottom thereof the cross or through hole 22 substantially perpendicular to the longitudinal axis of the holder. This cross hole 22 extends horizontally through the body portion and forms a receiver for the drift pin 17, shown most clearly in FIG. 1 used in connection with the cup portion 16 of a bit/holder insertion tool, a part of which is also shown in FIG. 1, and which will be discussed in more detail below.

This upper cylindrical segment 23 of the illustrated holder body 21 is, with the exception of the through hole 22 mentioned previously, generally solid and provides a substantial portion adding bulk and toughness to the combination bit/holder 15. As shown most clearly in FIGS. 2 and 3, the upper surface 34 of the holder is also made of the same steel as the remainder of the holder and includes an annular trough 35 in which an annular tungsten carbide sleeve 36 is positioned and brazed in place. The trough provides a retainer for an annular braze disk (not shown) which when melted adheres the base of the annular tungsten carbide ring 36 to the trough bottom. Radially inwardly of the tungsten carbide ring is an annular steel axially extending flange 37 that includes a central tapered cutout portion 38. A reverse taper tungsten carbide insert 40 is fitted into that tapered bore 38 and brazed therein. The top 41 of the tungsten carbide insert 40 extends substantially beyond the top 42 of the steel annular ring 37 and with the exception of a generally cylindrical recess 43 in the top surface thereof is constructed substantially similar to the cutting tool bit shown and disclosed in the present inventor's issued U.S. Pat. No. 6,739,327. The tungsten carbide reverse taper insert 40 provides a toughened insert for holding a commercially available diamond coated tip 44 which has a generally cylindrical tungsten carbide base 45 and a diamond coated tip which may be conical 33, flat 46 or oval 47 in cross section as shown in FIG. 2. Similarly to the tungsten carbide members previously mentioned, the base 45 of the tip insert 33 is brazed into the tungsten carbide reverse tapered insert member 40.

It should be noted that during assembly, only the top part of the bit/holder body 23 is heated by a inductance coil surrounding same to a temperature just slightly over the melting point of the brazing discs used, i.e., about 1300 degrees F. The careful positioning of the inductance coils provides for heating a minimal area of the upper portion 23 of the bit/holder 15, thus minimally affecting the grain structure, hardness, toughness etc. of the holder itself.

Figure 4:
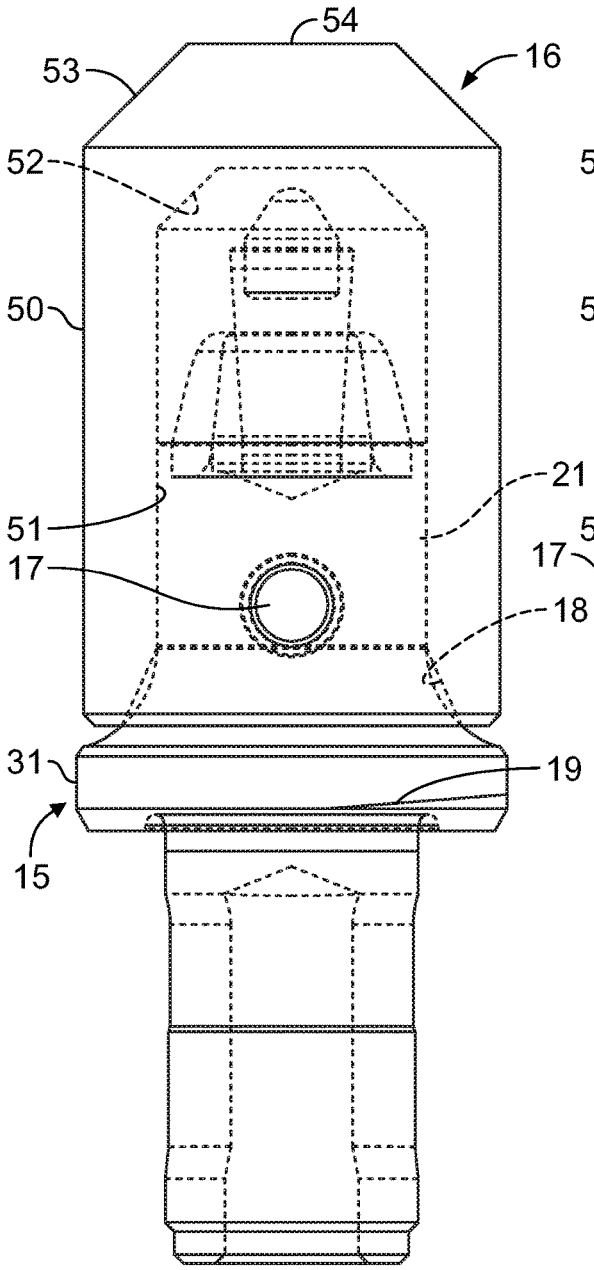
FIG. 4 is a side elevational view of the first embodiment of the combination diamond coated bit/bit holder shown in FIG. 3 with a cross section of the female end of the holder insertion tool of FIG. 1 shown as mounted over the forward end of the bit/holder in accordance with implementations of this disclosure.
Figure 5:
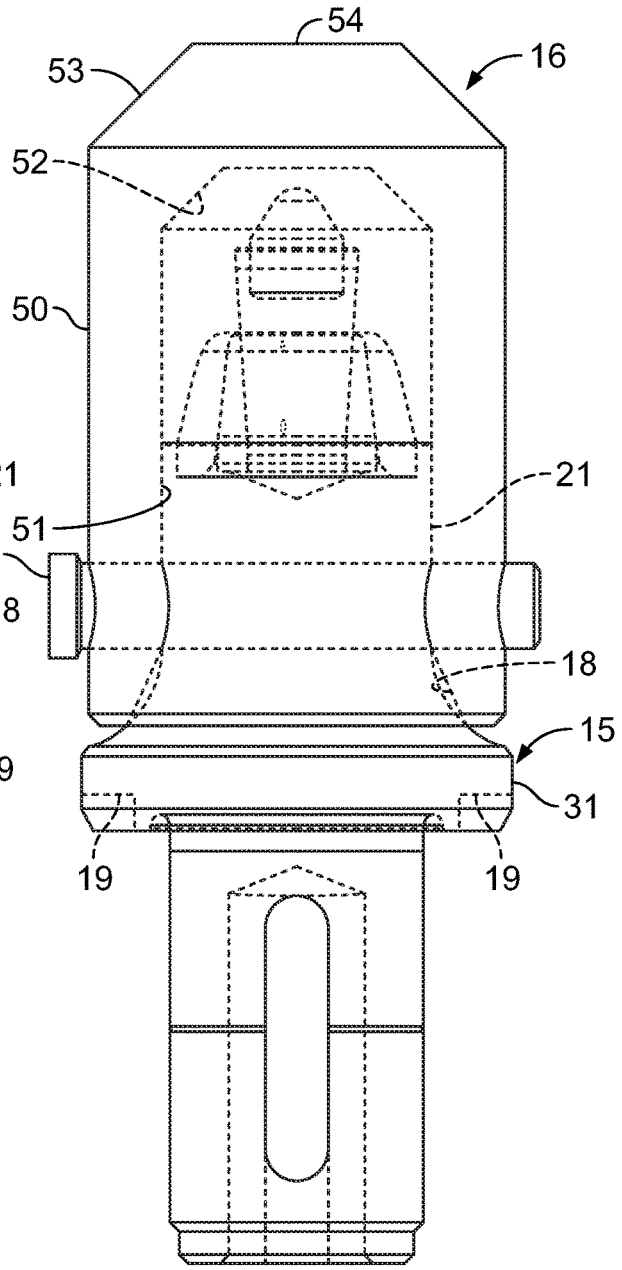
FIG. 5 is a front elevational view of the first embodiment of the combination diamond coated bit/holder shown in FIG. 4 with a cross section of the female end of the bit/holder insertion tool shown in FIG. 4 having the drift pin positioned through both the removal tool and the combination bit/holder in accordance with implementations of this disclosure.

Referring to FIGS. 4 and 5, the combination diamond tip bit/holder 15 shown in FIGS. 4 and 5 is exactly the same as that described in FIGS. 1-3. What is shown in FIGS. 4 and 5 is the mounting of the female or cup shape bit portion 16 of a bit insertion/removal tool, generally at 49, (FIG. 7) as it appears mounted on the top or holder body 21 of the combination bit/holder 15 together with the drift pin 17 positioned through the central portion of the holder body 21 and the outer annular wall of the cup or female insertion-removal member 16.

As shown in FIGS. 1, 4, and 5, the female member 16 is generally cup shaped, having an outer cylindrical wall 50 and an inner, generally cylindrical bore 51 or hollow portion sized to rather loosely fit over the outside of the top of the holder body 21 with a generally flared distal portion 18 sized to fit over the sloped segment 32 of the bottom of the holder body 21 upwardly adjacent the tire portion thereof.

A bore 20-20 horizontally through the walls of the female cup member 16 is sized and positioned to align with the through or cross bore 22 in the holder body 21 to allow a drift pin 17 to be loosely (slidably) positioned therethrough. The upper hollow or bored out portion of the cup member body fits over the diamond coated bit 33, tungsten carbide insert 40, and the tungsten annular ring 36 at the recess 35 in the top wall 34 of the holder body 21. The upper portion of the cup is, in this embodiment, tapered to a frustoconical shape 53 having a generally flat upper surface 54.

Referring to FIGS. 7 and 8, the female or cup portion 16, as mentioned previously, includes an upper threaded bore 55 centrally therethrough which is adapted to receive an Acme threaded rod 56 therein as a part of a bit insertion/removal tool 49. In order to maintain the cup 16 on the Acme threaded rod 56, a nut 57 is threaded on the rod and tightened against the upper annular wall of the cupped member 16 to secure same thereon. The Acme threaded rod 56 extends from the female cup member 16 to a distal stop 58 on the opposite end of the Acme threaded rod. In between is slidably mounted a dual handle hammer member 60 having a central annular portion 61 with a central bore 62 therethrough slightly larger than the outer dimension of the Acme thread for sliding along the threaded rod 56. One-hundred and eighty degrees apart on opposite sides of the annular central member are mounted hand holds 63-64 perpendicularly to the bore through the central member 61, each having a form fitting grip on its distal end. In operation, once the female cup member 16 is fitted over the body portion 21 of the bit/holder 15 and the drift pin 17 positioned therethrough, the double hand hold slider 60 may be quickly moved axially along the Acme threaded rod 56 and rammed onto the stop 58 at the distal end thereof to provide axial hammer type outward force to enable the removal of the bit holder 15 from its respective bit block bore (not shown).

Referring to FIGS. 6, 6*a*, and 6*b*, a first modification of the diamond coated bit/holder 15 of the present disclosure shown in FIGS. 1-5 is substantially identical to the holder 21, tungsten carbide ring 36, and tip 33 of that embodiment. The only difference being the mounting of a steel receiving cup 65 being about ⅜-1 inch, in height, that is brazed into the forward recess 43 of the reverse taper insert 40.

The diamond coated tip 33, 33*a*, 46 and 47 is brazed into the hollow cup forward portion 66 of the steel cup insert 65. The reasoning behind the addition of the cup shaped thick bottom 67 of the steel insert 65 relates to the ductility of the steel vs. the non-ductility of the tungsten carbide insert 40. The use of a solid bottomed 67 steel cup 65 member allows the ductility of that thick cylindrical bottom pad to cushion the repeated hammer blows received at the diamond coated tip 33*a*. This added ductility to the tip end 33*a* of the bit allows that bit/holder 15 to be used not only in removing MacAdam, but also in removing a concrete and other hardened and non-homogenous materials, thus giving added life and a widened field of use for the bit/holder combination 15 over previously known diamond coated bits. Further, the tungsten carbide to steel to tungsten carbide sequence of the disclosed modification yields substantially stronger bonds than brazing tungsten carbide to tungsten carbide.

Figure 9:
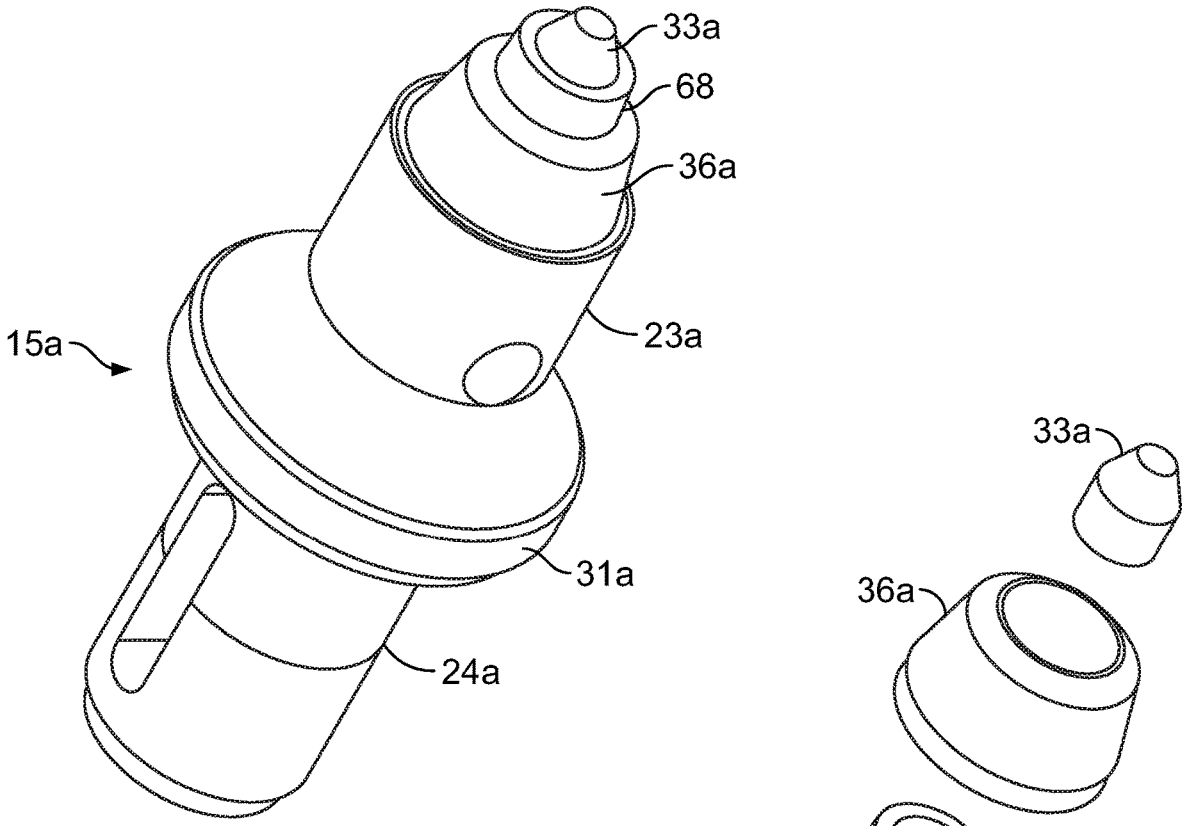
FIG. 9 is a top ¼ perspective view of a second modification of the first embodiment of the combination diamond coated bit/holder incorporating an annular steel front end of the bit holder adapted to receive the tungsten carbide diamond coated tip insert therein in accordance with implementations of this disclosure.
Figure 10:
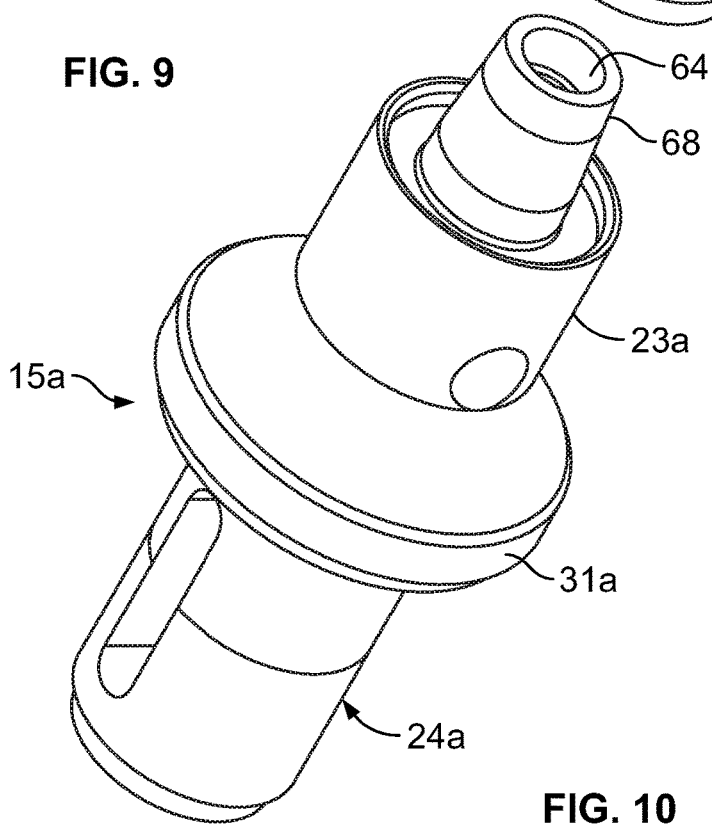
FIG. 10 is an exploded view of the second modification of the first embodiment of the combination diamond coated bit/holder shown in FIG. 9 with the annular tungsten carbide ring exploded out of its annular pocket more clearly showing the steel front end of the bit holder of FIG. 9 adapted to receive the tungsten carbide diamond coated insert therein to provide added ductility and shock absorption to the assembly in accordance with implementations of this disclosure.

Referring to FIGS. 9 and 10, a second modification of bit/holder 15*a* of the present disclosure is generally shown. As with the previous modification, the portion of the holder including the shank 24*a*, tire portion 31*a*, mid and most of the upper body portion 23*a* of the bit/holder 15*a* are identical to that shown in the first embodiment. However, the axially extending upper annular flange 68 of the holder 15*a* immediately inwardly adjacent the tungsten carbide protective ring 36*a* is substantially solid with the exception of a generally cylindrical recess 64 sized for the fitting of the diamond covered commercial insert 33*a* which may be brazed therein. This modification of the uppermost portion of the holder body provides a substantial steel mounting for the diamond coated tungsten carbide body tip 33*a*. This substantial steel upper portion 68 provides added ductility, even more so than the steel thick bottomed cup 65 shown in FIG. 6. This increased ductility acts as a shock absorber for the diamond coated tungsten carbide tip 33, 33*a*, 46 and 47 enabling same to the used in more than just the asphalt or macadam removal, which was a limitation to the use of previously known diamond coated bit tips in road milling. Additionally, the steel to tungsten carbide braze joint between the tip and the holder body is stronger than a tungsten carbide to tungsten carbide braze joint.

Figure 11:
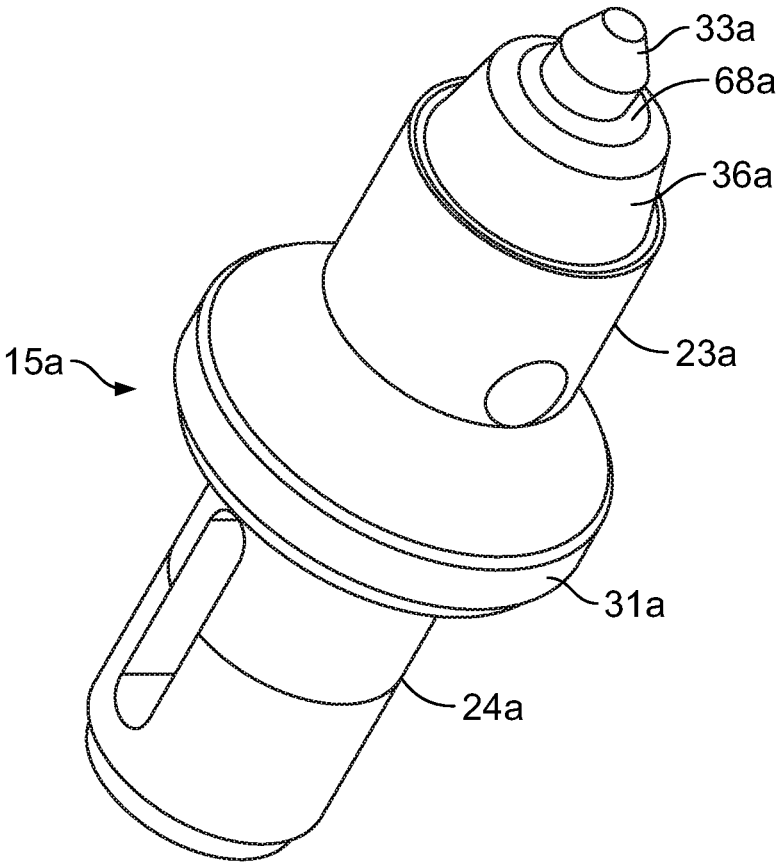
FIG. 11 is a top ¾ perspective of the second modification of the first embodiment of the combination diamond coated bit/holder shown in FIG. 9 as it appears when the bit/holder has been in use a short time with an upper distal annular end worn away in accordance with implementations of this disclosure.

Referring to FIG. 11, the bit/holder 15*a* shown in FIGS. 9 and 10 is shown as it appears after use in the field has started. In use, the bit/holder 15*a* wears adjacent its tip insert 33*a*. The steel annular ring 42*a* which forms the top of the upper body 23*a* of the bit/holder wears away quickly during use, as shown at 68*a* in FIG. 11, somewhat similarly to upper portion 66 of cup 65 shown in FIGS. 6, 6*a*, and 6*b*, to the extent where it generally coincides with the top surface of the tungsten carbide annular ring 36*a* after use.

The purpose of the extended initial portion of the steel annular ring 68 shown in FIGS. 9 and 10 is to seat the diamond tipped insert 33*a* in its recess 43*a* as shown in FIG. 10. Initially, the tungsten carbide annular ring 36*a* is seated in its recess at the top of the body portion 23*a* with a ring of brazing material between that recess and the bottom of the annular ring 36*a*. A combination of the holder and tungsten carbide annular ring are heated to between 1,650-2,000 degrees F. in the first operation to join those parts of the bit holder together into a unitary structure. The tungsten carbide ring and holder are quenched and tempered to a hardness of RC 40-48, in a separate heat treatment process.

Next, the PCD or diamond insert 33*a* is positioned in recess 43*a* preferably over a silver brazing disc (not shown). This combination is then heated between 1,000-1,300 degrees F. by an induction heater (not shown) which encircles the upper tip portion of the bit holder 15*a*. The flow of heat through the annular steel ring 68 more effectively magnetically couples to the iron in the steel in the ring 68 to transfer heat to the tungsten carbide. The heat more efficiently goes through the steel to melt the flux and braze material between the insert 33*a* and the recess 43*a* of the steel ring 68. These two processes that join both the tungsten carbide annular ring 36*a* and the diamond tip insert 33*a* to the upper body 23*a* and recess 43*a* of the inner annular ring 68 are made at two differing temperatures to provide a more stable unitary structure in the end-finished bit holder of the present disclosure.

Figure 12:
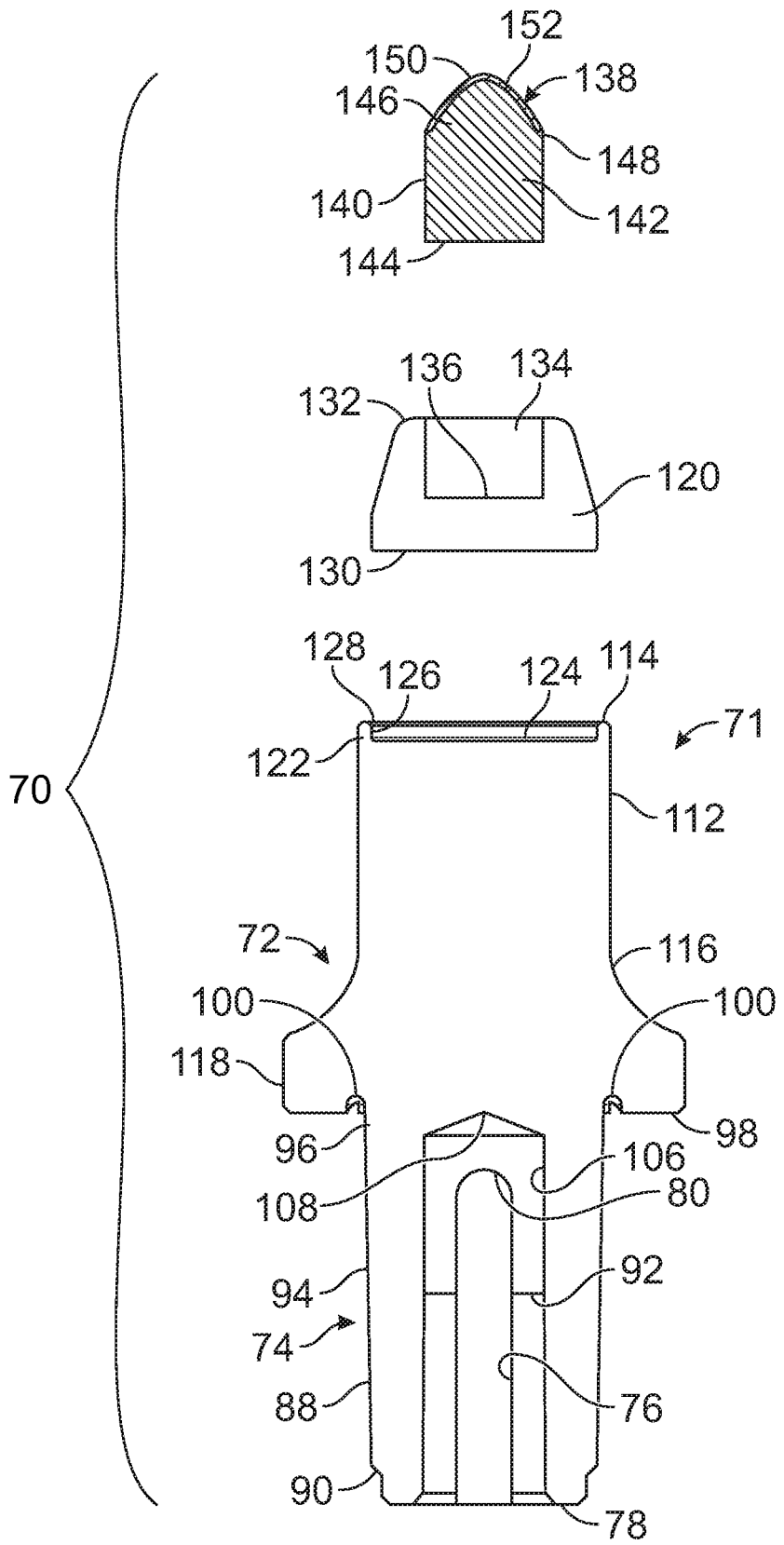
FIG. 12 is an exploded elevation view of a second embodiment of a combination diamond coated bit/holder, shown with a first embodiment of a bit tip insert, in accordance with implementations of this disclosure.
Figure 13:
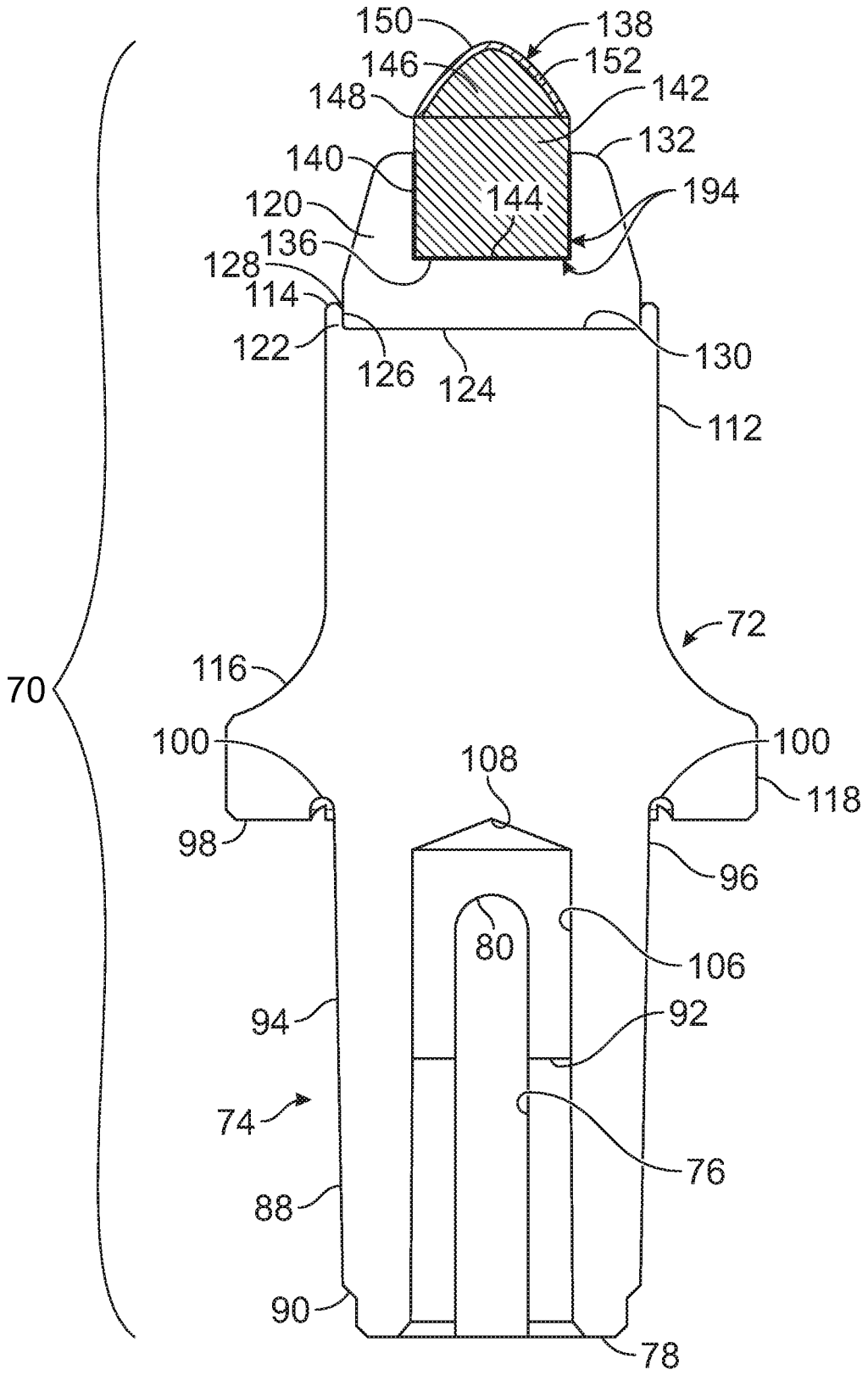
FIG. 13 is an elevation view of the second embodiment of the combination diamond coated bit/holder, shown assembled into unitary construction, in accordance with implementations of this disclosure.

Referring to FIGS. 12 and 13, a second embodiment of a combination diamond coated bit/holder 70 of the present disclosure is shown. The bit/holder 70 is a unitary bit 138 and bit holder 71 construction. The bit holder 71, in this illustrated embodiment, is a standard 2¾ inch length shank bit holder that includes a body 72 and a generally cylindrical hollow shank 74 axially depending from a bottom of the body 72. The shank 74 includes an elongate first slot 76 extending from a generally annular distal end 78 of the shank 74 axially upward or forward to an upper termination 80 adjacent the upper or forward end of the shank 74. In this exemplary implementation, the shank 74 also includes an internally oriented second slot 82 (FIG. 14) located approximately 180 degrees around the annular shank 74 from the first slot 76. This second slot 82 is parallel to the first slot 76 and is an internal slot having a rearward semicircular termination 84 (FIG. 14) inwardly adjacent to the distal end 78 of the shank 74 and a forward semicircular termination 86

(FIG. 14) generally coinciding longitudinally and axially with the upper termination 80 of the first slot 76.

In this illustrated embodiment, the shank 74 also includes a lower or first tapered portion 88 running axially from a stepped shoulder 90 adjacent the distal end 78 of the shank 74. The stepped shoulder 90 is disposed between the lower tapered portion 88 and the distal end 78. A diameter of the stepped shoulder 90 increases, or steps up, as it axially extends from the distal end 78 to the lower tapered portion 88. The first tapered portion 88 runs upwardly or axially from the stepped shoulder 90 of the shank 74 and terminates generally mid slot 76 longitudinally. The shank 74 also includes an annular shoulder 92 separating the lower tapered portion 88 from an upper or second tapered portion 94 which extends from the shoulder 92 to generally adjacent to the top of the shank 74 or forward terminations 80, 86 of slots 76, 82, respectively. The annular shoulder 92 is disposed between the first tapered portion 88 and the second tapered portion 94. A diameter of the annular shoulder 92 decreases, or steps down, as it axially extends from the first tapered portion 88 to the second tapered portion 94. A generally cylindrical top portion 96 of the shank 74 extends from a position adjacent the second tapered portion 94 towards a generally annular back flange 98 that denotes the base or bottom of the body 72 of the bit/holder 70. The top of the shank 74 may include a rounded junction 100 between the top portion 96 of the shank 74 and the generally annular back flange 98 of the body 72 of the bit/holder 70, which is provided to avoid sharp corners which may provide an area for stress cracks to begin. In other embodiments, the shank 74 may comprise different configurations, for example, the lower portion 88 and/or the upper portion 94 of the shank 17 may comprise a generally cylindrical shape, a slight draw angle, or a slight draft angle.

The generally annular flange 98 includes a pair of horizontal slots 102-102 (one shown in FIG. 14) generally perpendicular to the longitudinal axis of the combination bit/holder 70, one on either side of the generally annular flange 98. The horizontal slots 102-102 are adapted to receive a pair of bifurcated fork tines that may be inserted between the base of the body 72 of the bit/holder 70 and a base block 104 (FIGS. 14 and 15), or a base block 170 (FIGS. 16 and 17), into which the shank 74 of the bit/holder combination is inserted and retained by outward radial force in use.

A central bore 106 longitudinally and axially extending from the distal end 78 of the shank 74 terminates at bore termination 108, which in this illustrated embodiment has a conical shape, and is approximately at the upper end of the shank 74. This allows the generally C-shaped annular sidewall of the shank 74 to radially contract when the shank is mounted in a bore 110 (FIG. 14) in the base block 104 or in a bore 172 (FIG. 16) in the base block 170.

In this second illustrated embodiment of the bit/holder 70, the bit holder body 72, which in this embodiment is preferably made of 4340 or equivalent steel, includes a generally cylindrical or annular upper body portion 112 depending from a forward end 114 of the upper body portion 112. A mediate body portion 116 subjacent the upper body portion 112 generally slopes axially and radially outwardly to a radially extending tire portion 118. Additionally, in an alternate embodiment, a mid-section of the upper body portion 112 of the bit/holder 70 may include a cross or through hole (not shown) substantially perpendicular to the longitudinal axis of the bit/holder 70. This cross hole (not shown) extends horizontally through the upper body portion 112 and forms a receiver for a drift pin (not shown) used in connection with a cup portion of a bit/holder insertion-removal tool.

The bit holder body 72, in order to provide superior brazing of the base of a tungsten carbide transition member 120 within a recess of the forward end 114 of the upper body portion 112, includes a forwardly extending annular collar 122 that is created on the bit holder body 72 to provide a trough 124 onto which the tungsten carbide member 120 is mounted and brazed. In this illustrated embodiment, the annular collar 122 includes a cylindrical bottom inner wall 126 and a tapered top inner wall or countersink 128. The vertical outer wall of the annular collar 122 will keep brazing material from flowing outwardly of the joinder between the base 130 of the tungsten carbide member 120 and the trough 124 onto which the tungsten carbide member 120 is positioned. The trough 124 is positioned perpendicular to the axis of the bit/holder 70. The tungsten carbide member 120 is seated in the trough 124, which may preferably be brazed into unitary construction with the remainder of the bit/holder 70. The top or forwardmost portion of the tungsten carbide member 120 terminates generally at a forward end 132 of the bit holder body 72 of the combination bit/holder 70.

The tungsten carbide member 120 includes a recess or bore 134 that extends axially inwardly from the top of the tungsten carbide member 120. The bore 134 extends a distance longitudinally axially inwardly from the top of the tungsten carbide member 120 to define a base or bore termination 136, adjacent the base 130 of the tungsten carbide member 120, for a bit tip insert 138. In this illustrated embodiment, the bore 134 has a hollow generally cylindrical shape. In other embodiments, the bore can also have a radially declining taper or a slight draw or draft angle.

The bore 134 of the tungsten carbide member 120 provides a space for receiving a complementary shaped generally cylindrical outer surface 140 of a base portion 142 of the first embodiment of the bit tip insert 138 for the bit/holder 70 combination which is brazed within the recess 134 of the tungsten carbide member 120. Braze material 194 (FIGS. 13 and 23) completely attaches to the outer surface 140 of the base portion 142 and a flat distal end 144 of the bit tip insert 138 and the bore 134 and bore termination 136 of the tungsten carbide member 120. In other embodiments, the outer surface can also have a radially declining taper or a slight draw or draft angle. In one exemplary implementation of the first embodiment, the tip insert 138 can have a diameter in the range of ⅝ inch to 1¼ inch. In this first embodiment, the base portion 142 extends to the flat distal end 144 of the tip insert 138. In other embodiments, the distal end 144 can have various shapes that correspond and/or are complementary to the bore termination 136 of the tungsten carbide member 120. The base portion 142 may be made of steel, tungsten carbide, brass, or other similar materials and includes a tip 146 at an outer or forward end 148 of the base portion 142. The bit tip insert 138 can be of any height and/or length. The tip 146 can have a frustoconical shape, a flat generally cylindrical puck shape, a parabolic ballistic shape, and/or an arcuate shape. In this exemplary implementation, the bit tip insert 138 is generally conical and includes a parabolic curved section below an apex of the tip insert 138.

In this first embodiment of the bit tip insert 138, an outer surface or forward end 150 of tip 146 has an overlay 152 of a polycrystalline diamond (PCD) structure. The outer surface 150 of the tip 146 may also include an overlay 152 of an industrial diamond material and may comprise a single coating or outer layer or multiple coatings or outer layers of such industrial diamond material, natural diamond, polycrystalline diamond material, polycrystalline diamond composite or compact material, and/or thermally stable polycrystalline (TSP) diamond. Additional fusing additives, such as cobalt, are used to enhance the connective fusion and bonding of the diamond particles together. The single or multiple coatings or layers may be formed by a high pressure, high temperature process. The overlay 152 occupies a large radial and axial profile of the tip 146 which allows faster heat transfer into a region subjacent to the overlay 152 PCD layer. Excessively high heat, such as temperatures above 1300 degrees F., is the greatest cause of PCD failure due to the diamond connective failure. The quick heat transfer from the tip 146 of the PCD cutting zone, which is generally less than ½ inch depth of cut per tip engagement, to the subjacent region below the PCD drastically reduces the possibility of a temperature of the tip 146 of the PCD reaching temperatures at or above 1300 degrees F. for any extended period of time, thereby avoiding failure of the PCD layer.

Figure 14:
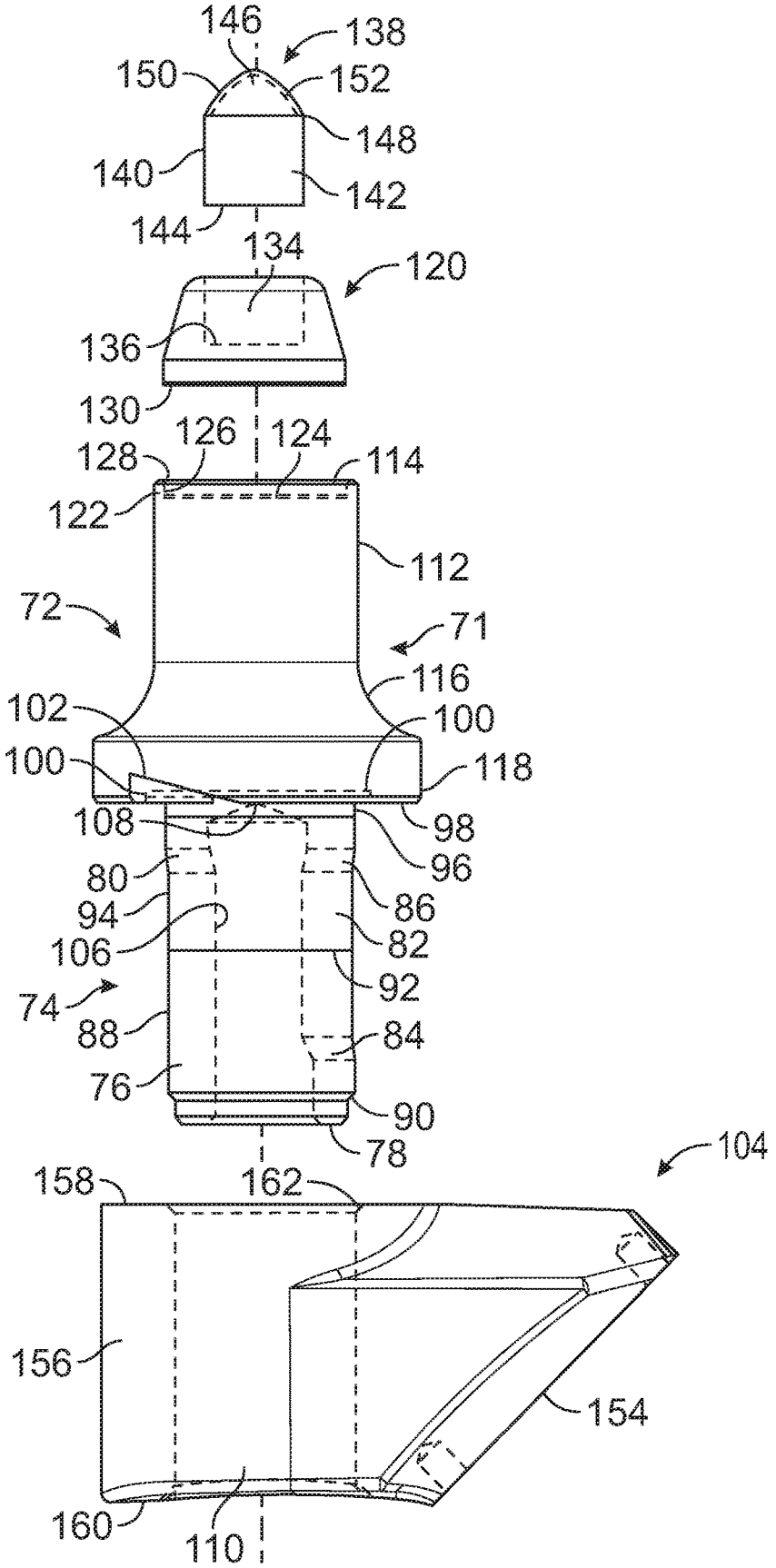
FIG. 14 is an exploded elevation view of the second embodiment of the combination diamond coated bit/holder and a first embodiment of a bit holder block, showing invisible internal elements in dotted lines, in accordance with implementations of this disclosure.
Figure 15:
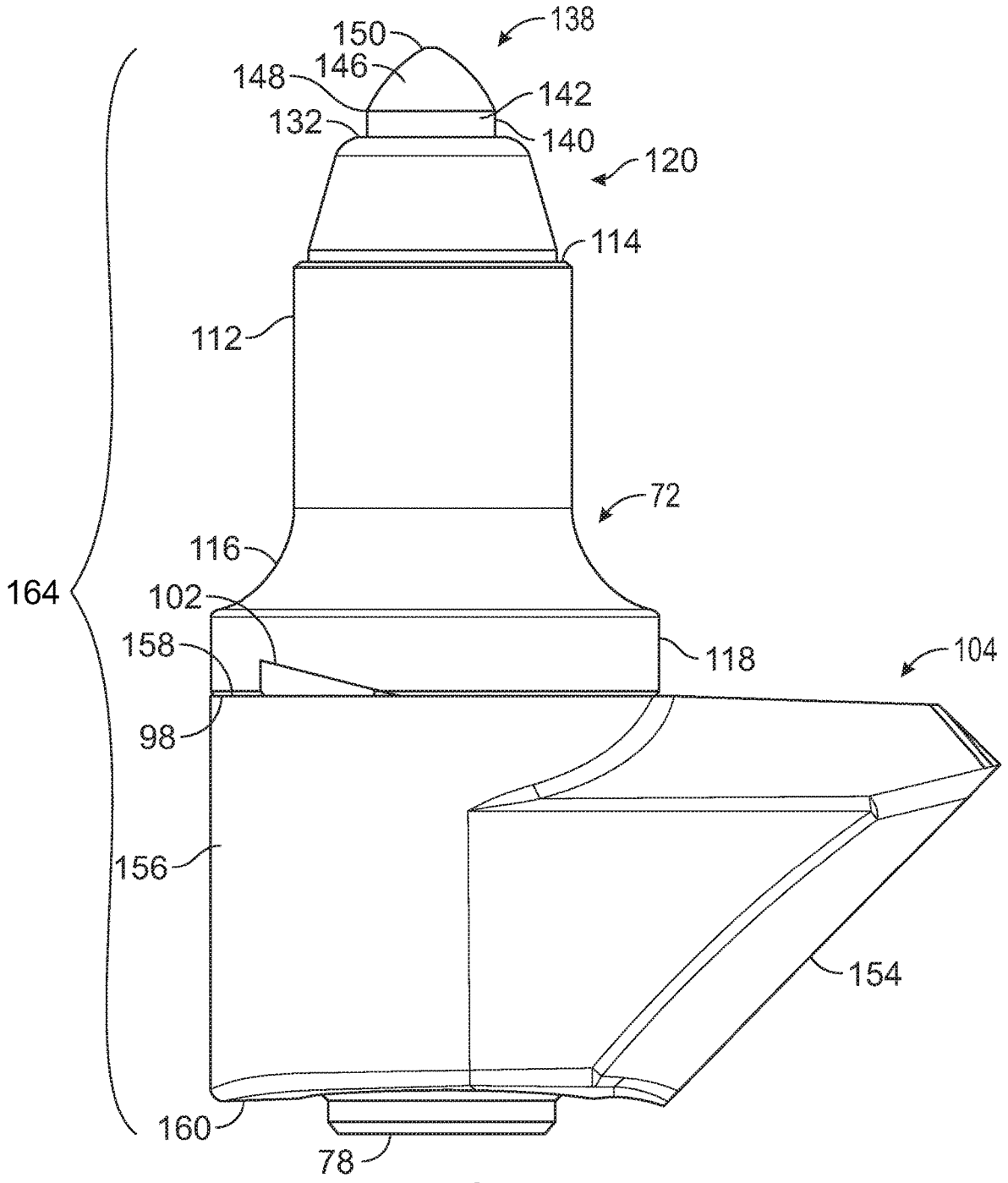
FIG. 15 is an elevation view of the second embodiment of the combination diamond coated bit/holder assembled into the first embodiment of the bit holder block in accordance with implementations of this disclosure.

Referring to FIGS. 14 and 15, the second embodiment of the unitary bit/holder 70 is shown with a first embodiment of the base block 104. The shank 74 of the bit holder 71 is sized to fit within the bore 110 of the base block 104, as shown in FIG. 15. The base block 104 comprises a base or mounting portion 154 and a receiving portion 156 opposite the base 154 that extends from a front face 158 of the base block 104 to a rear face 160 of the base block 104, which, in this exemplary implementation, is approximately 2¾ inch in length. The base 154 can be flat or slightly concave to fit a drum or additional mounting plates on which a plurality of base blocks can be mounted. The receiving portion 156 includes the base block bore 110, shown in FIG. 14, that is symmetrical with the shank 74 along a centerline. The bore 110, in this exemplary implementation, is generally cylindrical and includes a countersink 162 adjacent the front face 158 of the base block 104. In other embodiments, the bore 110 may be cylindrical, generally cylindrical, inwardly tapered, outwardly tapered, or any combination thereof.

To assemble the second embodiment of the bit/holder 70 into a unitary structure, the tungsten carbide member 120 is positioned in the trough 124, which contains a brazing material, of the bit holder body 72 and the base portion 142 of the bit tip insert 138 is positioned in the bore 134, which contains a brazing material, of the tungsten carbide member 120. The bit tip insert 138 and the tungsten carbide member 120 are brazed in a single brazing process. The collar 122, the trough 124 and the forward end 114 of the upper body portion 112, which in this embodiment are made of steel, provide for greater expansion during the brazing process. The collar 122, the trough 124 and the forward end 114 of the upper body portion 112 and the braze material will expand more than the tungsten carbide member 120 and the base portion 142 of the bit tip insert 138 at the same brazing temperature, thereby providing a greater compression force and holding the bit tip insert 138 more securely and firmly.

To assemble the unitary bit/holder 70 in the bore 110 of the base block 104, the shank 74 is inserted into the bore 110 of the base block 104 until the back flange 98 seats on the front face 158 of the base block 104. The slots 76, 82 allow the shank 74 to radially compress when inserted into the base block bore 110 of the receiving portion 156 forming an interference fit between the shank 74 and the base block bore 110. The force between the diametrically contracted shank 74 and the base block bore 110 maintains and retains the unitary bit/holder 70 in the base block 104. The unitary bit/holder 70 and the base block 104 are assembled together to form a bit assembly 164, as shown in FIG. 15.

Figure 16:
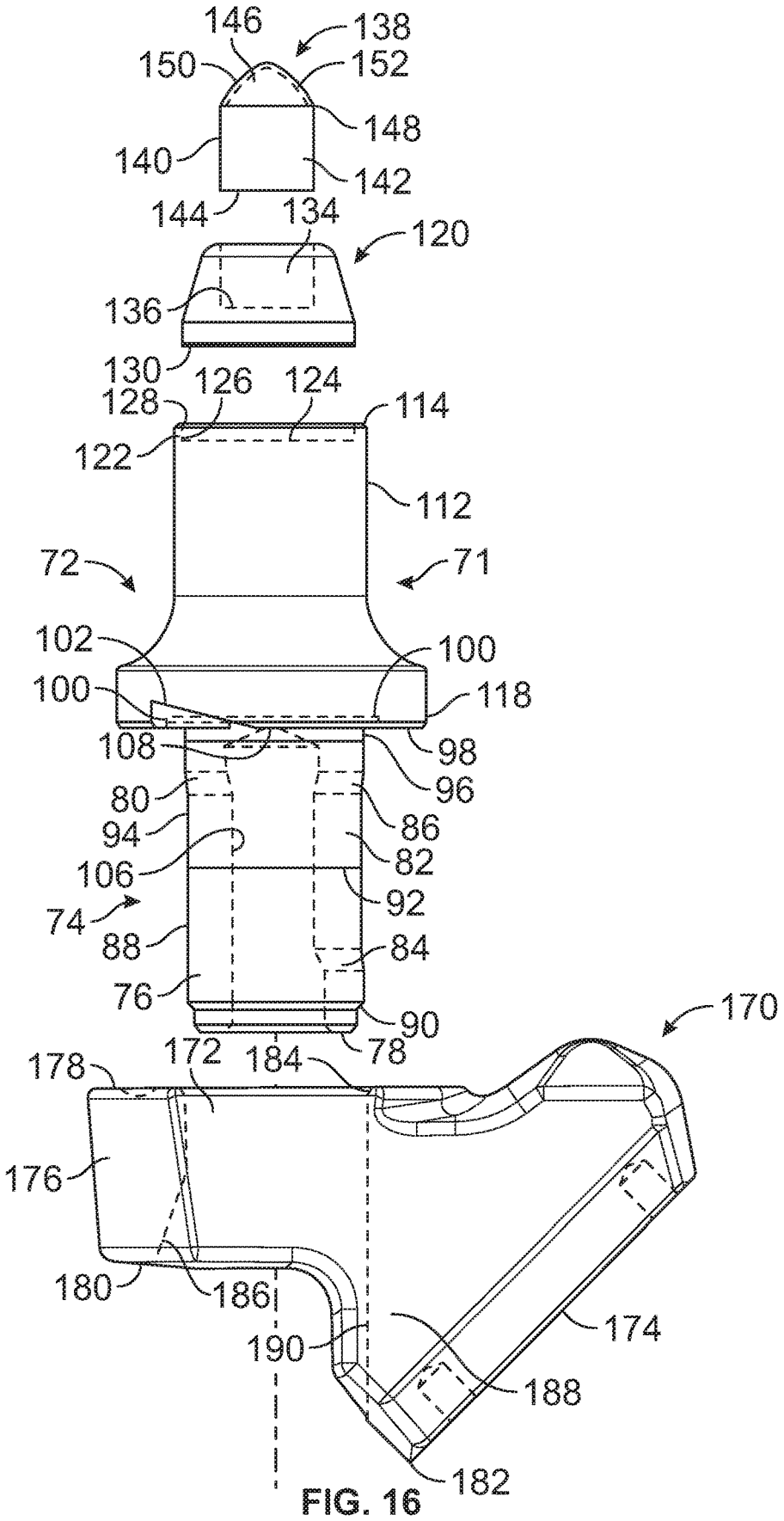
FIG. 16 is an exploded elevation view of the second embodiment of the combination diamond coated bit/holder and a second embodiment of a bit holder block, showing invisible internal elements in dotted lines, in accordance with implementations of this disclosure.
Figure 17:
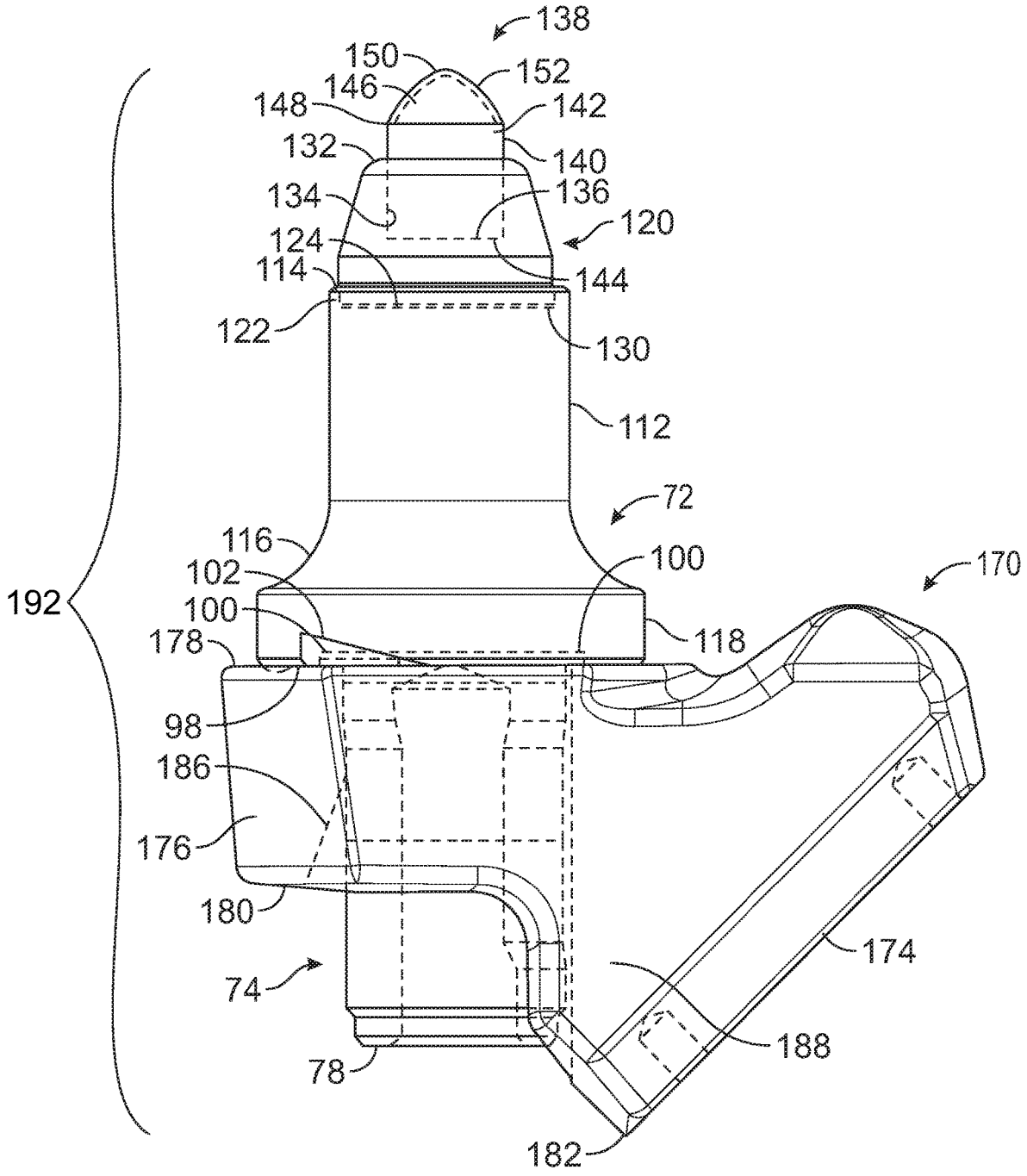
FIG. 17 is an elevation view of the second embodiment of the combination diamond coated bit/holder assembled into the second embodiment of the bit holder block, showing invisible internal elements in dotted lines, in accordance with implementations of this disclosure.
Figure 25:
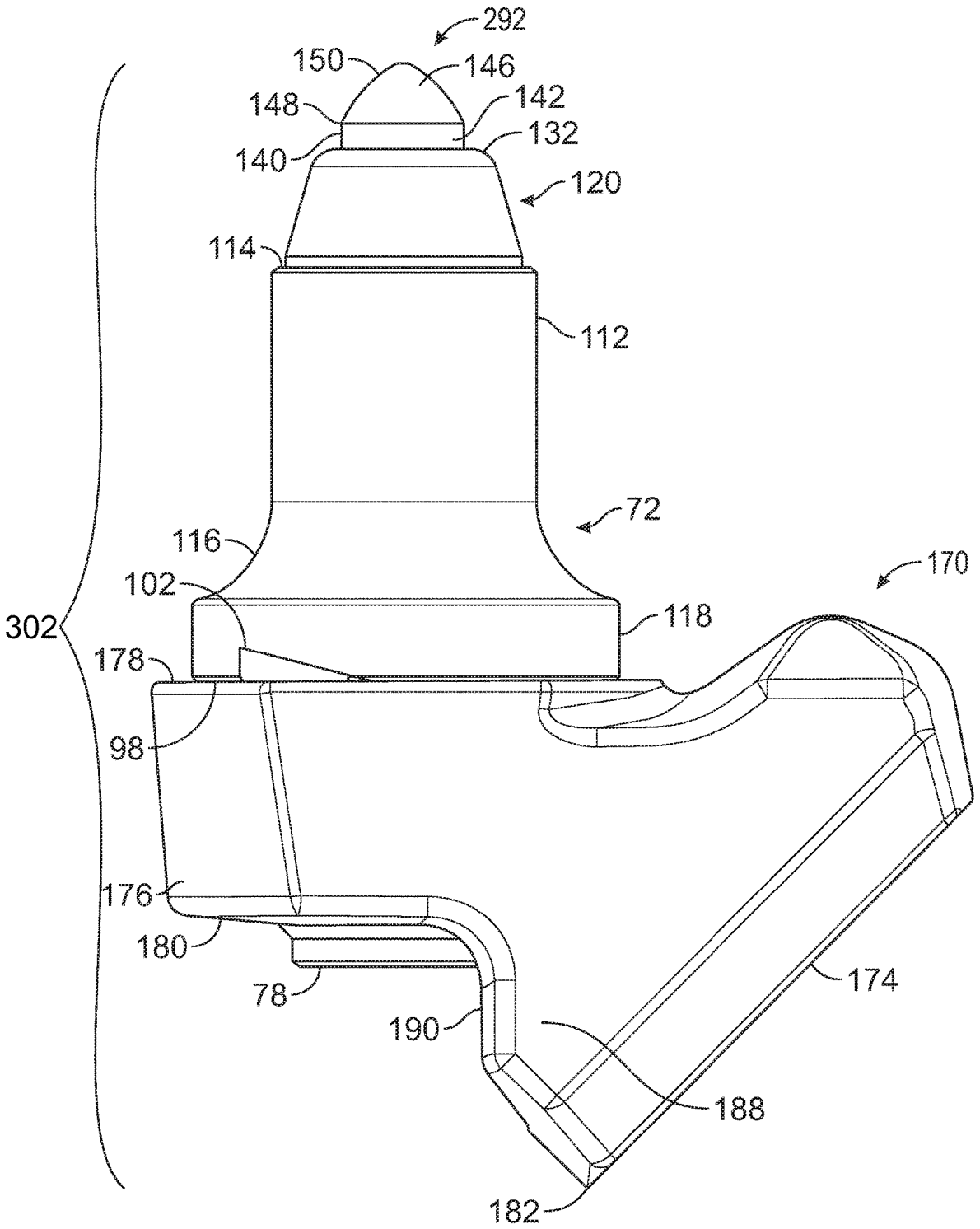
FIG. 25 is an elevation view of the fourth embodiment of the combination diamond coated bit/holder assembled into the second embodiment of the bit holder block in accordance with implementations of this disclosure.
Figure 29:
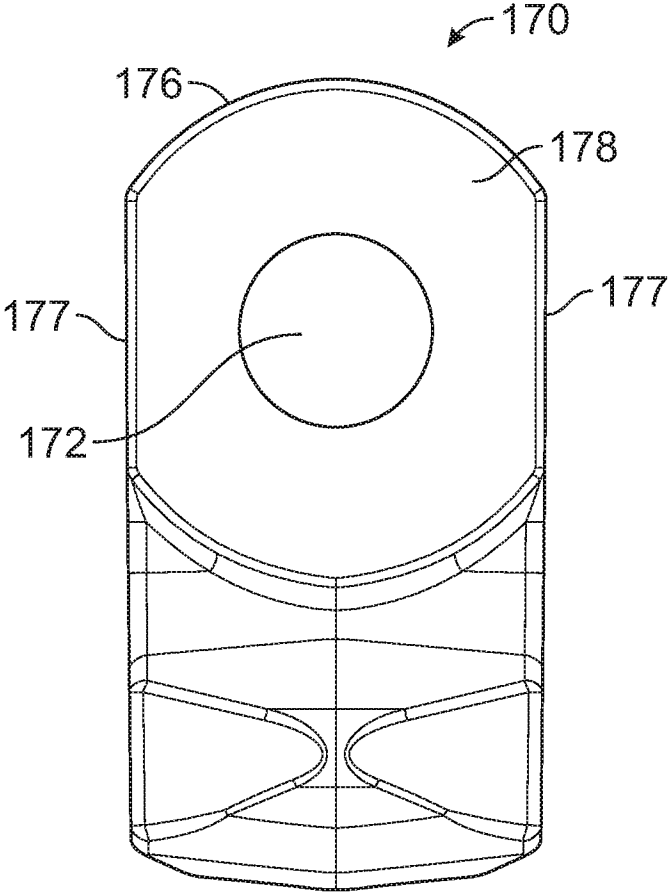
FIG. 29 is a front elevation view of the first modification of the second embodiment of the bit holder block in accordance with implementations of this disclosure.
Figure 28:
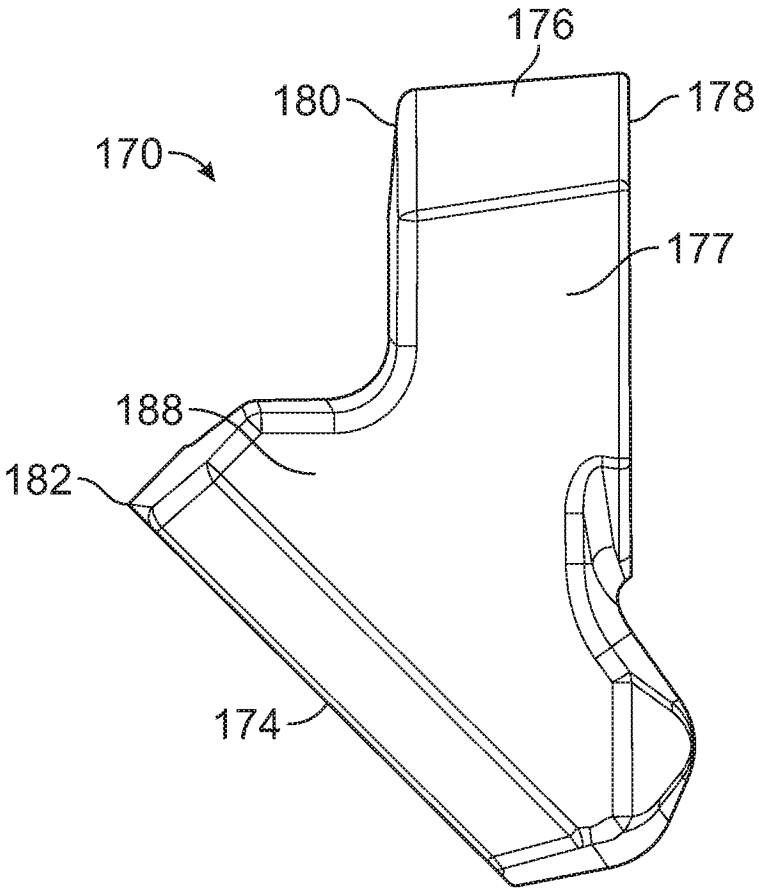
FIG. 28 is a side elevation view of a first modification of the second embodiment of the bit holder block in accordance with implementations of this disclosure.

Referring to FIGS. 16 and 17, the second embodiment of the unitary bit/holder 70 is shown with a second embodiment of the base block 170. The shank 74 of the bit holder 71 is sized to fit within the bore 172 of the base block 170, as shown in FIG. 17. The base block 170 comprises a base or mounting portion 174 and a shortened front end or receiving portion 176 opposite the base 174. The shortened front end or receiving portion 176 can have an annular or generally cylindrical shape or, in a first modification of the second embodiment of the base block 170, the shortened front end or receiving portion 176 can include opposing flat sides 177 as shown in FIGS. 25, 28, and 29. The base 174 can be flat or slightly concave to fit a drum or additional mounting plates on which a plurality of base blocks can be mounted. The shortened receiving portion 176, in this exemplary implementation, is approximately 1½ inches in length or greater from a front face 178 of the base block 170, also corresponding to the front face of the shortened receiving portion 176, to a rear face 180 of the shortened receiving portion 176, which provides added access space of approximately ⅞ inch from the rear face 180 of the shortened receiving portion 176 to a rear 182 of the base block 170. The receiving portion 176 includes the base block bore 172, shown in FIG. 16, that is symmetrical with the shank 74 along a centerline and has, in this exemplary implementation, a central nominal 1½ inch diameter. The bore 172, in this exemplary implementation, is tapered and includes a countersink 184 adjacent the front face 178 of the base block 170. In other embodiments, the bore 172 may be cylindrical, generally cylindrical, inwardly tapered, outwardly tapered, or any combination thereof.

The rear face 180 of the shortened receiving portion 176 includes, in this embodiment, a semicylindrical angular slot 186 at the radially outermost portion of the base block bore 172. The angular slot 186 allows added room for a drift pin or tool (not shown) to operate to drive out either bit/holder 70. A portion 188 of the base block 170 includes an extension of an arcuate segment 190 of the bore 172 that extends from the rear face 180 of the shortened receiving portion 176 to a location adjacent the rear 182 of the base block 170. The arcuate segment 190 of the tapered bore 172, in this exemplary implementation, has a reduced radius from the radius of the bore 172.

To assemble the second embodiment of the bit/holder 70 into a unitary structure, the tungsten carbide member 120 is positioned in the trough 124, which contains a brazing material, of the bit holder body 72 and the base portion 142 of the bit tip insert 138 is positioned in the bore 134, which contains a brazing material, of the tungsten carbide member 120. The bit tip insert 138 and the tungsten carbide member 120 are brazed in a single brazing process. The collar 122, the trough 124 and the forward end 114 of the upper body portion 112, which in this embodiment are made of steel, provide for greater expansion during the brazing process. The collar 122, the trough 124 and the forward end 114 of the upper body portion 112 and the braze material will expand more than the tungsten carbide member 120 and the base portion 142 of the bit tip insert 138 at the same brazing temperature, thereby providing a greater compression force and holding the bit tip insert 138 more securely and firmly.

To assemble the unitary bit/holder 70 in the bore 172 of the base block 170, the shank 74 is inserted into the bore 172 of the base block 170 until the back flange 98 seats on the front face 178 of the base block 170. The slots 76, 82 allow the shank 74 to radially compress when inserted into the base block bore 172 of the shortened receiving portion 176 forming an interference fit between the shank 74 and the base block bore 172. The extension of the arcuate segment 190 of the bore 172 further engages the 2¾ inch long shank 74 of the bit holder 71 adjacent the distal end 78 of the shank 74 and provides sufficient sideways force against that portion of the shank 74 to retain the shank 74 in the base block 170. The force between the diametrically contracted shank 74 and the base block bore 172, along with the additional sideways force on the distal end 78 of the shank 74, maintains and retains the unitary bit/holder 70 in the base block 170. The unitary bit/holder 70 and the base block 170 are assembled together to form a bit assembly 192, as shown in FIG. 17.

Figure 18:
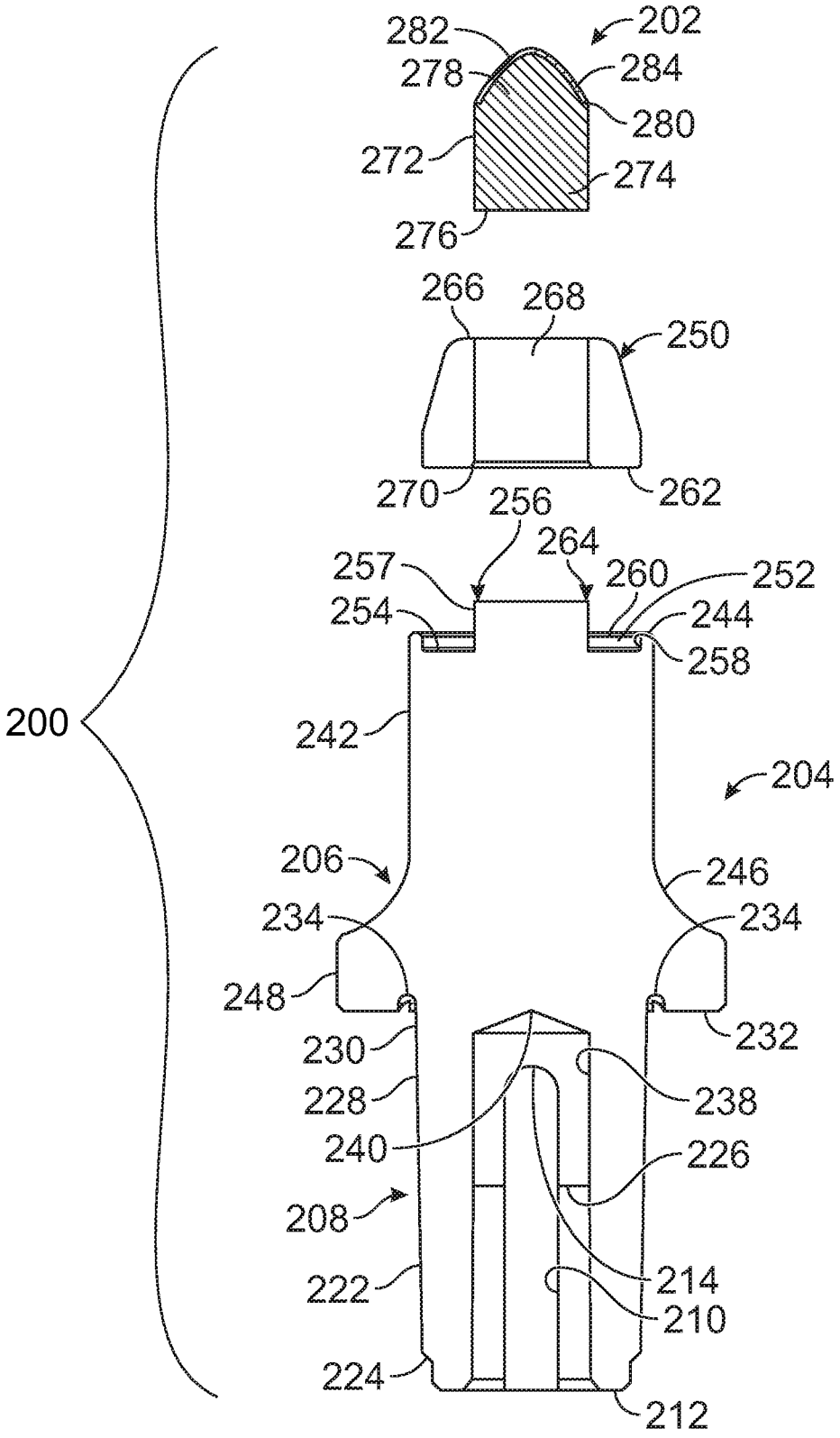
FIG. 18 is an exploded elevation view of a third embodiment of a combination diamond coated bit/holder, shown with the first embodiment of the bit tip insert, in accordance with implementations of this disclosure.
Figure 19:
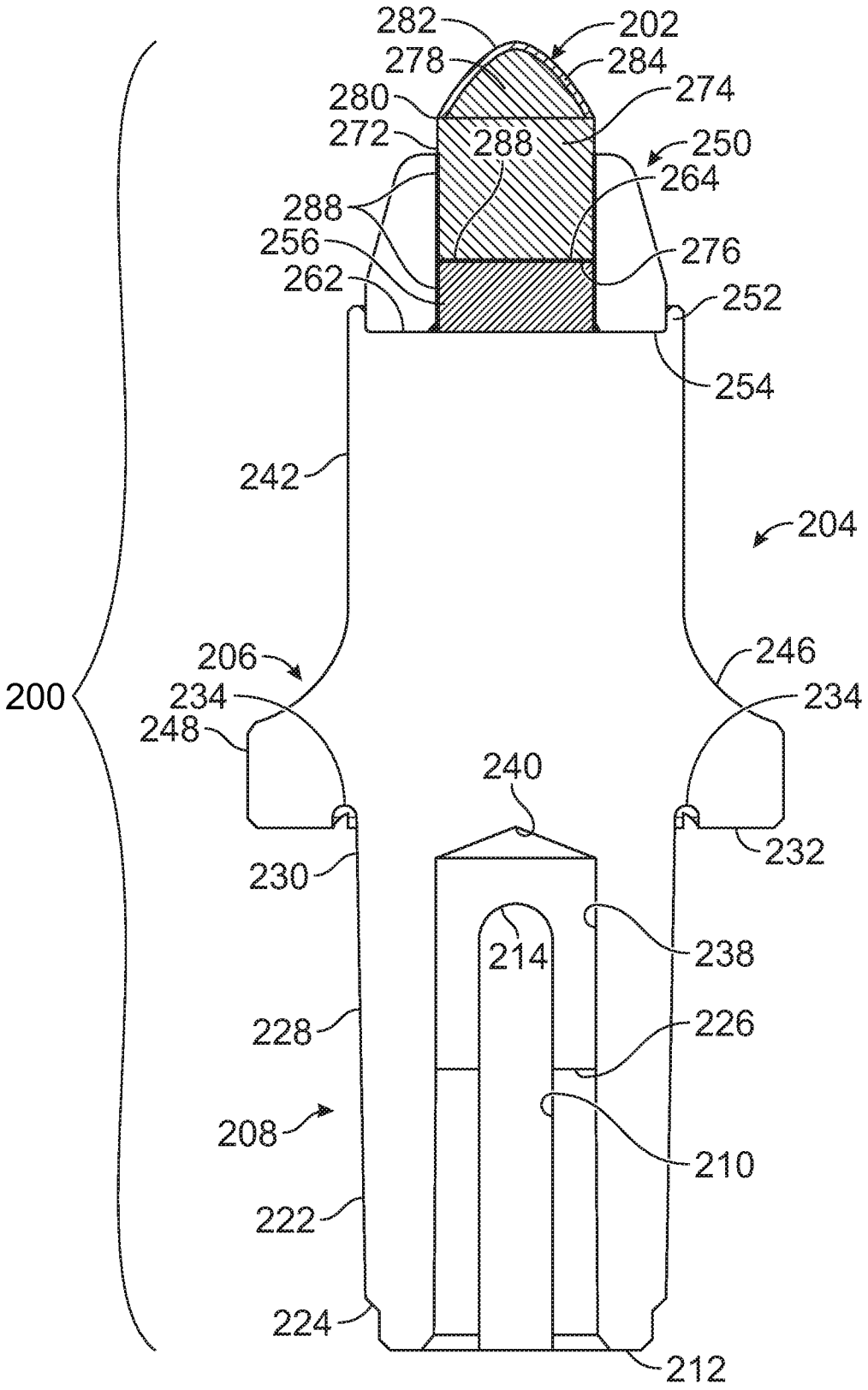
FIG. 19 is an elevation view of the third embodiment of the combination diamond coated bit/holder, shown assembled into unitary construction, in accordance with implementations of this disclosure.

Referring to FIGS. 18 and 19, a third embodiment of a combination diamond coated bit/holder 200 of the present disclosure is shown. The bit/holder 200 is a unitary bit 202 and bit holder 204 construction. The bit holder 204, in this illustrated embodiment, is a standard 2¾ inch length shank bit holder that includes a body 206 and a generally cylindrical hollow shank 208 axially depending from a bottom of the body 206. The shank 208 includes an elongate first slot 210 extending from a generally annular distal end 212 of the shank 208 axially upward or forward to an upper termination 214 adjacent the upper or forward end of the shank 208. In this exemplary implementation, the shank 208 also includes an internally oriented second slot 216 (FIG. 20) located approximately 180 degrees around the annular shank 208 from the first slot 210. This second slot 216 is parallel to the first slot 210 and is an internal slot having a rearward semicircular termination 218 (FIG. 20) inwardly adjacent the distal end 212 of the shank 208 and a forward semicircular termination 220 (FIG. 20) generally coinciding longitudinally and axially with the upper termination 214 of the first slot 210.

In this illustrated embodiment, the shank 208 also includes a lower or first tapered portion 222 running axially from a stepped shoulder 224 adjacent the distal end 212 of the shank 208. The stepped shoulder 224 is disposed between the lower tapered portion 222 and the distal end 212. A diameter of the stepped shoulder 224 increases, or steps up, as it axially extends from the distal end 212 to the lower tapered portion 222. The first tapered portion 222 runs upwardly or axially from the stepped shoulder 224 of the shank 208 and terminates generally mid slot 210 longitudinally. The shank 208 also includes an annular shoulder 226 separating the lower tapered portion 222 from an upper or second tapered portion 228 which extends from the shoulder 226 to generally adjacent to the top of the shank 208 or forward terminations 214, 220 of slots 210, 216, respectively. The annular shoulder 226 is disposed between the first tapered portion 222 and the second tapered portion 228. A diameter of the annular shoulder 226 decreases, or steps down, as it axially extends from the first tapered portion 222 to the second tapered portion 228. A generally cylindrical top portion 230 of the shank 208 extends from a position adjacent the second tapered portion 228 towards a generally annular back flange 232 that denotes the base or bottom of the body 206 of the bit/holder 200. The top of the shank 208 may include a rounded junction 234 between the top portion 230 of the shank 208 and the generally annular back flange 232 of the body 206 of the bit/holder 200, which is provided to avoid sharp corners which may provide an area for stress cracks to begin. In other embodiments, the shank 208 may comprise different configurations, for example, the lower portion 222 and/or the upper portion 228 of the shank 208 may comprise a generally cylindrical shape, a slight draw angle, or a slight draft angle.

The generally annular flange 232 includes a pair of horizontal slots 236-236 (one shown in FIG. 20) generally perpendicular to the longitudinal axis of the combination bit/holder 200, one on either side of the generally annular flange 232. The horizontal slots 236-236 are adapted to receive a pair of bifurcated fork tines that may be inserted between the base of the body 206 of the bit/holder 200 and a base block 104 (FIGS. 20 and 21), or a base block 170 (FIGS. 16 and 17), into which the shank 208 of the bit/holder combination is inserted and retained by outward radial force in use.

A central bore 238 longitudinally and axially extending from the distal end 212 of the shank 208 terminates at bore termination 240, which in this illustrated embodiment has a conical shape, and is approximately at the upper end of the shank 208. This allows the generally C-shaped annular sidewall of the shank 208 to radially contract when the shank is mounted in the bore 110 (FIG. 20) in the base block 104 or in the bore 172 (FIG. 16) in the base block 170.

In this third illustrated embodiment of the bit/holder 200, the bit holder body 206, which in this embodiment is preferably made of 4340 or equivalent steel, includes a generally cylindrical or annular upper body portion 242 depending from a forward end 244 of the upper body portion 242. A mediate body portion 246 subjacent the upper body portion 242 generally slopes axially and radially outwardly to a radially extending tire portion 248. Additionally, in an alternate embodiment, a mid-section of the upper body portion 242 of the bit/holder 200 may include a cross or through hole (not shown) substantially perpendicular to the longitudinal axis of the bit/holder 200. This cross hole (not shown) extends horizontally through the upper body portion 242 and forms a receiver for a drift pin (not shown) used in connection with a cup portion of a bit/holder insertion-removal tool.

The bit holder body 206, in order to provide superior brazing of the base of a tungsten carbide transition member 250 within a recess of the forward end 244 of the upper body portion 242, includes a forwardly extending annular collar 252 that is created on the bit holder body 206 to provide an annular trough 254 around a forward extension 256, which in this illustrated embodiment is cylindrical, of the bit holder body 206 onto which the tungsten carbide member 250 is mounted and brazed. In this illustrated embodiment, the annular collar 252 includes a cylindrical bottom inner wall 258 and a tapered top inner wall or countersink 260. The vertical outer wall of the annular collar 252 will keep brazing material from flowing outwardly of the joinder between the base 262 of the tungsten carbide member 250 and the annular trough 254 onto which the tungsten carbide member 250 is positioned. The annular trough 254 is therearound positioned perpendicular to the axis of the bit/holder 200 from the interior of which axially extends the smaller radially oriented upper or forward extension 256. Around this forward extension 256 is fitted the tungsten carbide member 250, seated in the annular trough 252 around a sidewall 257 of the forward extension 256, which may preferably be brazed into unitary construction with the remainder of the bit/holder 200. The top or forwardmost portion 264 of the forward extension 256 terminates at a position between a top 266 of the tungsten carbide member 250 and the base 262 of the tungsten carbide member 250.

The tungsten carbide member 250 includes a bore 268 that, in this illustrated embodiment, axially extends from the top 266 of the tungsten carbide member 250 to the base 262 of the tungsten carbide member 250. The bore 268 includes a countersink 270 adjacent the base 262 of the tungsten carbide member 250. In this illustrated embodiment, the bore 268 has a hollow generally cylindrical shape. In other embodiments, the bore can also have a radially declining taper or a slight draw or draft angle.

The bore 268 of the tungsten carbide member 250 provides a space for receiving a complementary shaped generally cylindrical outer surface 272 of a base portion 274 of the first embodiment of the bit tip insert 202 for the bit/holder 200 combination which is brazed within the recess 268 of the tungsten carbide member 250. Braze material 288 (FIGS. 19 and 27) completely attaches to the outer surface 272 of the base portion 274 and a flat distal end 276 of the bit tip insert 202, the bore 268 of the tungsten carbide member 250, and to the top 264 and sidewall 257 of the forward extension 256. In other embodiments, the outer surface can also have a declining taper or a slight draw or draft angle. In one exemplary implementation of the first embodiment, the tip insert 202 can have a diameter in the range of ⅝ inch to 1¼ inch. In this first embodiment, the base portion 274 extends to the flat distal end 276 of the tip insert 202. In other embodiments, the distal end 276 can have various shapes that correspond and/or are complementary to the top 264 of the forward extension 256. The base portion 274 may be made of steel, tungsten carbide, brass, or other similar materials and includes a tip 278 at an outer or forward end 280 of the base portion 274. The bit tip insert 202 can be of any height and/or length. The tip 278 can have a frustoconical shape, a flat generally cylindrical puck shape, a parabolic ballistic shape, and/or an arcuate shape. In this exemplary implementation, the bit tip insert 202 is generally conical and includes a parabolic curved section below an apex of the tip insert 202.

In this first embodiment of the bit tip insert 202, an outer surface or forward end 282 of the tip 278 has an overlay 284 of a polycrystalline diamond (PCD) structure. The outer surface 282 of the tip 278 may also include an overlay 284 of an industrial diamond material and may comprise a single coating or outer layer or multiple coatings or outer layers of such industrial diamond material, natural diamond, polycrystalline diamond material, polycrystalline diamond composite or compact material, and/or thermally stable polycrystalline (TSP) diamond. Additional fusing additives, such as cobalt, are used to enhance the connective fusion and bonding of the diamond particles together. The single or multiple coatings or layers may be formed by a high pressure, high temperature process. The overlay 284 occupies a large radial and axial profile of the tip 278 which allows faster heat transfer into a region subjacent to the overlay 284 PCD layer. Excessively high heat, such as temperatures above 1300 degrees F., is the greatest cause of PCD failure due to the diamond connective failure. The quick heat transfer from the tip 278 of the PCD cutting zone, which is generally less than ½ inch depth of cut per tip engagement, to the subjacent region below the PCD drastically reduces the possibility of a temperature of the tip 278 of the PCD reaching temperatures at or above 1300 degrees F. for any extended period of time, thereby avoiding failure of the PCD layer.

Figure 20:
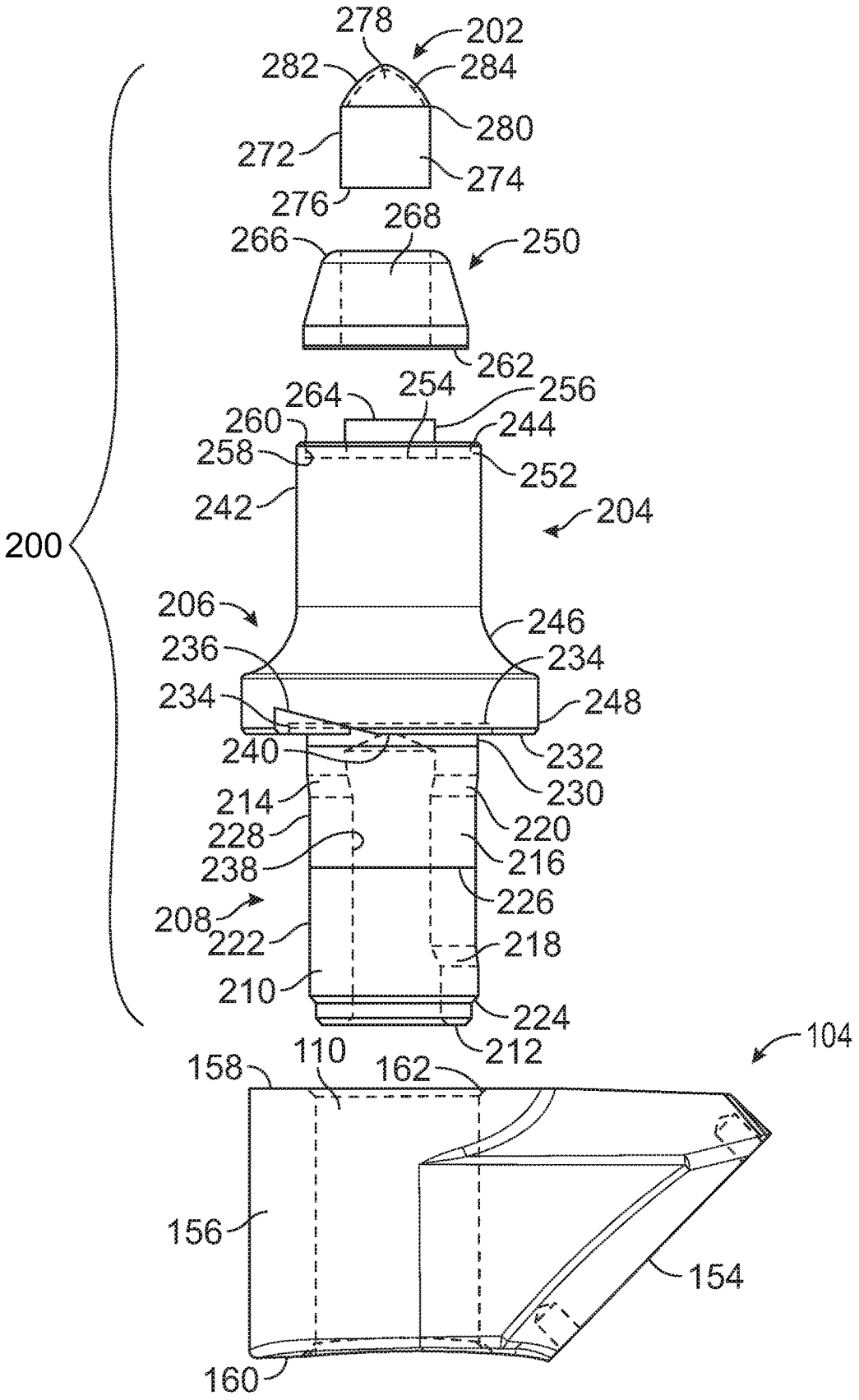
FIG. 20 is an exploded elevation view of the third embodiment of the combination diamond coated bit/holder and the first embodiment of the bit holder block, showing invisible internal elements in dotted lines, in accordance with implementations of this disclosure.
Figure 21:
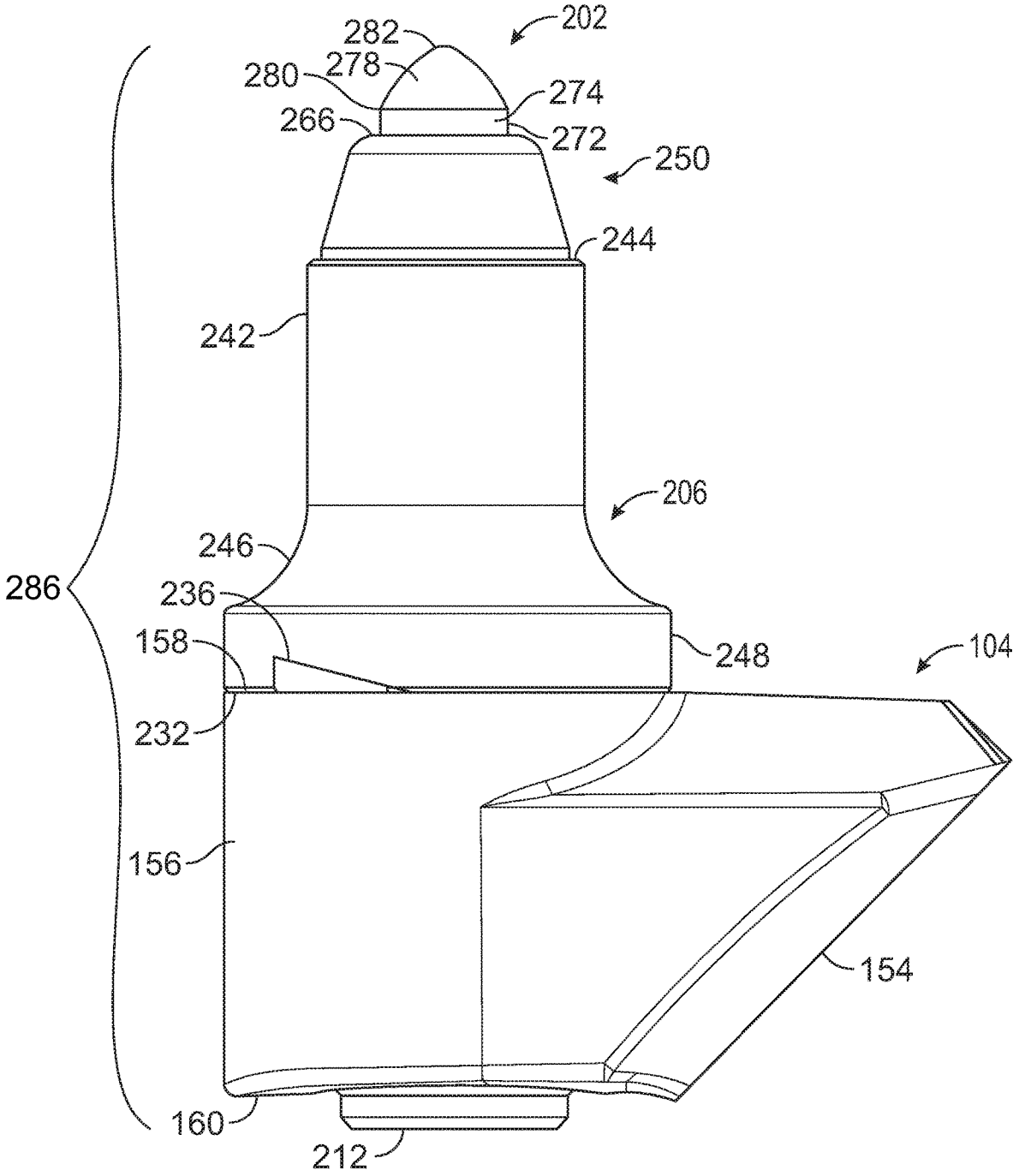
FIG. 21 is an elevation view of the third embodiment of the combination diamond coated bit/holder assembled into the first embodiment of the bit holder block in accordance with implementations of this disclosure.

Referring to FIGS. 20 and 21, the third embodiment of the unitary bit/holder 200 is shown with the first embodiment of the base block 104. The shank 208 of the bit holder 204 is sized to fit within the bore 110 of the base block 104, as shown in FIG. 20. To assemble the third embodiment of the bit/holder 200 into a unitary structure, the tungsten carbide member 250 is positioned around the forward extension 256, which contains a brazing material, and the base portion 274 of the bit tip insert 202 is positioned in the bore 268, which contains a brazing material, of the tungsten carbide member 250, such that the distal end 276 of the bit tip insert 202 rests on the top 264 of the forward extension 256. The bit tip insert 202 and the base 262 of the tungsten carbide member 250 are brazed in a single brazing process. The annular trough 254, the annular collar 252, the forward extension 256, and the forward end 244 of the upper body portion 242, which in this embodiment are made of steel, provide for greater expansion during the brazing process. The annular trough 254, the annular collar 252, the forward extension 256, and the forward end 244 of the upper body portion 242 and the braze material will expand more than the tungsten carbide member 250 and the base portion 274 of the bit tip insert 202 at the same brazing temperature, thereby providing a greater compression force and holding the bit tip insert 202 more securely and firmly.

To assemble the unitary bit/holder 200 in the bore 110 of the base block 104, the shank 208 is inserted into the bore 110 of the base block 104 until the back flange 232 seats on the front face 158 of the base block 104. The slots 210, 216 allow the shank 208 to radially compress when inserted into the base block bore 110 of the receiving portion 156 forming an interference fit between the shank 208 and the base block bore 110. The force between the diametrically contracted shank 208 and the base block bore 110 maintains and retains the unitary bit/holder 200 in the base block 104. The unitary bit/holder 200 and the base block 104 are assembled together to form a bit assembly 286, as shown in FIG. 21.

Figure 22:
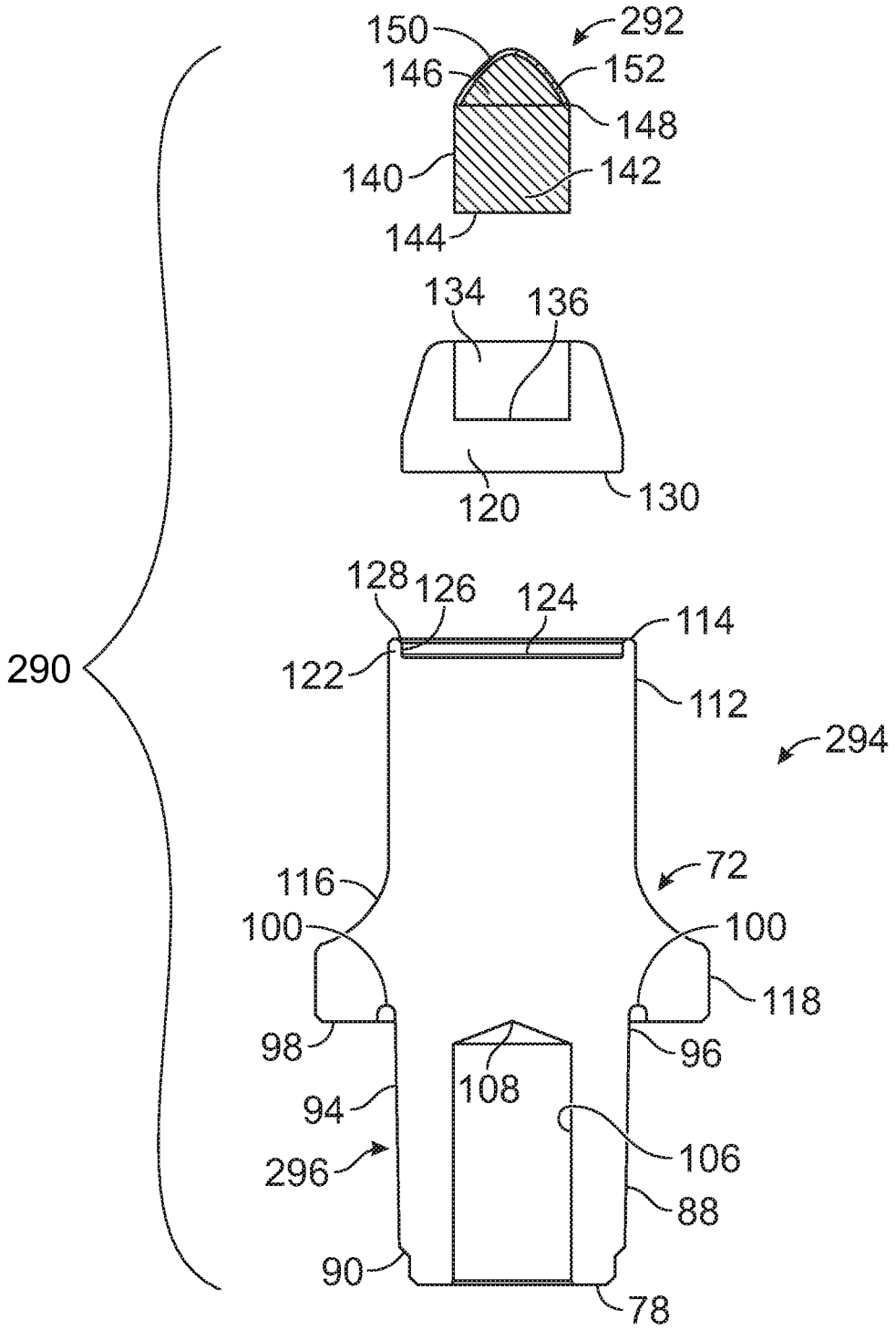
FIG. 22 is an exploded elevation view of a fourth embodiment of a combination diamond coated bit/holder, shown with the first embodiment of the bit tip insert, in accordance with implementations of this disclosure.
Figure 23:
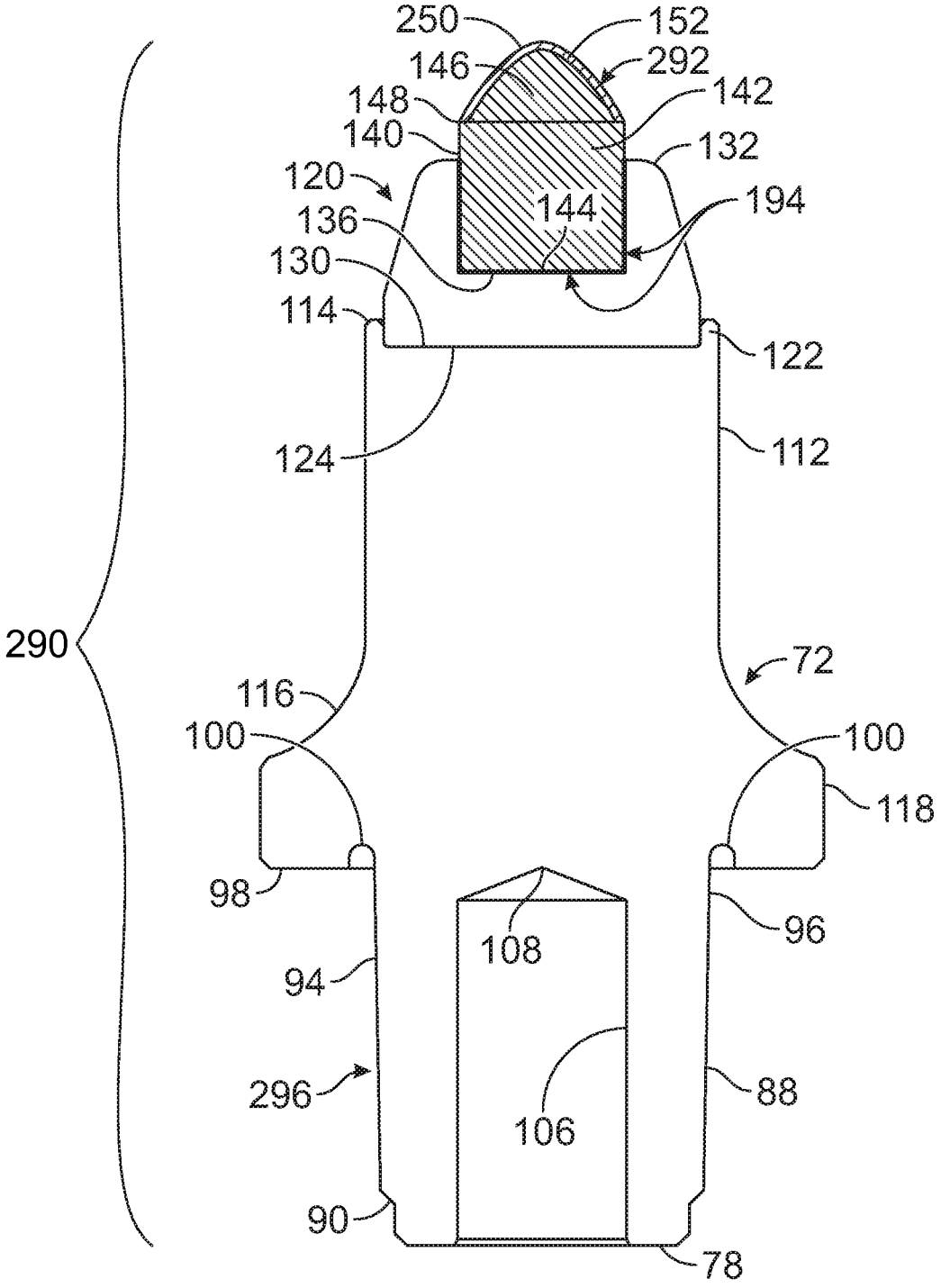
FIG. 23 is an elevation view of the fourth embodiment of the combination diamond coated bit/holder, shown assembled into unitary construction, in accordance with implementations of this disclosure.

Referring to FIGS. 22 and 23, a fourth embodiment of a combination diamond coated bit/holder 290 of the present disclosure is shown. The bit/holder 290 is a unitary bit 292 and bit holder 294 construction. The bit tip insert 292 can be of any height and/or length. The bit/holder 290 of the fourth embodiment is substantially the same as the bit/holder 70 of the second embodiment with an exception that the bit holder 294 includes a shank 296 that is shorter than the standard 2¾ inch length shank of a standard bit holder in which, in this exemplary implementation, the length of the shank 296 of the bit holder 294 is approximately a nominal 1¾ inches. Another difference between the bit/holder 290 of the fourth embodiment and the bit/holder 70 of the second embodiment is that the shank 296 of the bit holder 294, in this exemplary implementation, includes only an elongate wider first slot 298 extending from the generally annular distal end 78 of the shank 296 axially upward or forward to an upper termination 300 adjacent the upper or forward end of the shank 296. In another embodiment, the shank 296 can include an internally oriented second slot as described in the second embodiment of the bit/holder 70.

Figure 24:
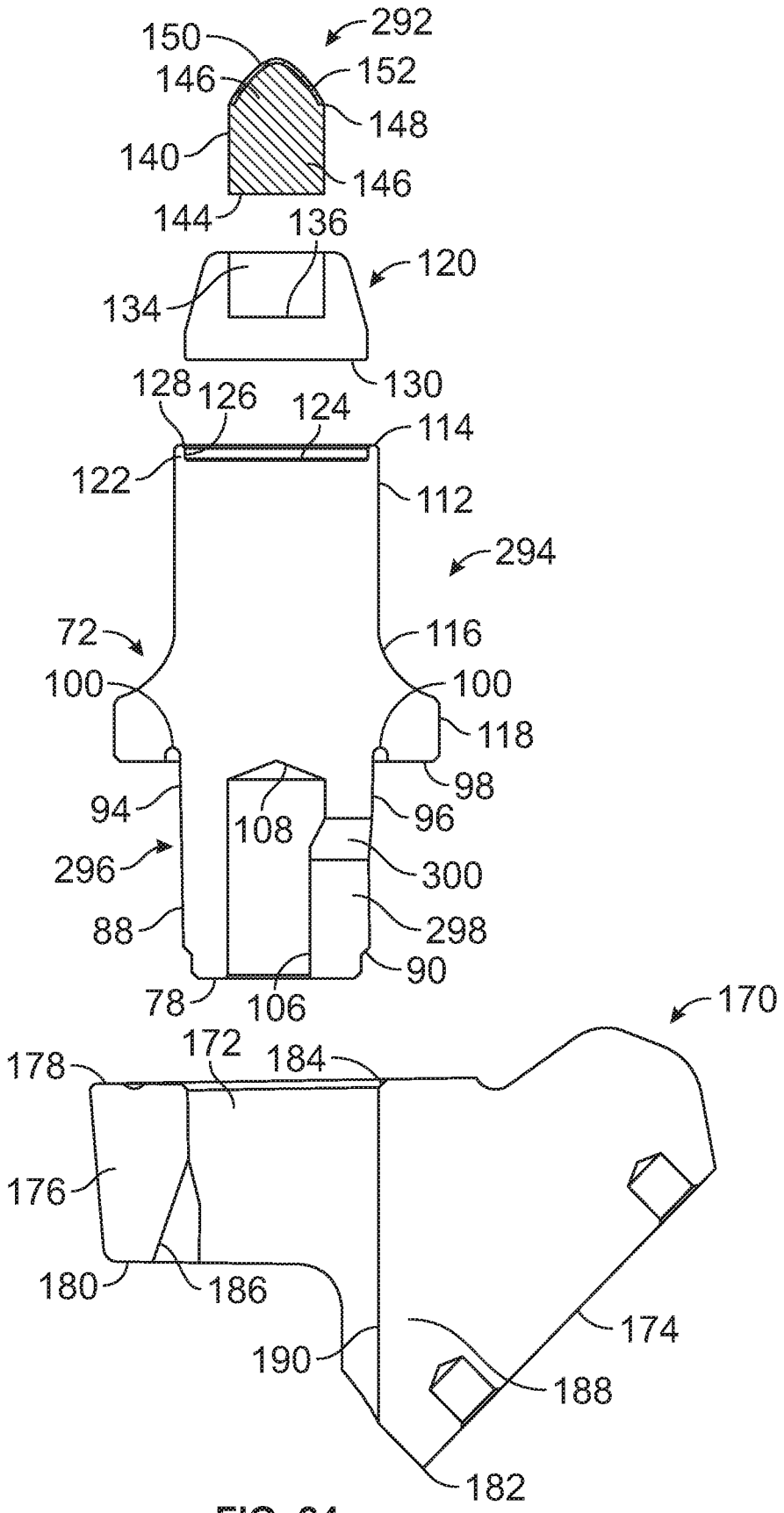
FIG. 24 is an exploded elevation view of the fourth embodiment of the combination diamond coated bit/holder and the second embodiment of the bit holder block in accordance with implementations of this disclosure.

Referring to FIGS. 24 and 25, the fourth embodiment of the unitary bit/holder 290 is shown with the second embodiment of the base block 170. The shank 296 of the bit holder 294 is sized to fit within the bore 172 of the base block 170, as shown in FIG. 25. To assemble the fourth embodiment of the bit/holder 290 into a unitary structure, the tungsten carbide member 120 is positioned in the trough 124, which contains a brazing material, of the bit holder body 72 and the base portion 142 of the bit tip insert 292 is positioned in the bore 134, which contains a brazing material, of the tungsten carbide member 120. The bit tip insert 292 and the tungsten carbide member 120 are brazed in a single brazing process. The collar 122, the trough 124 and the forward end 114 of the upper body portion 112, which in this embodiment are made of steel, provide for greater expansion during the brazing process. The collar 122, the trough 124 and the forward end 114 of the upper body portion 112 and the braze material will expand more than the tungsten carbide member 120 and the base portion 142 of the bit tip insert 138 at the same brazing temperature, thereby providing a greater compression force and holding the bit tip insert 138 more securely and firmly.

To assemble the unitary bit/holder 290 in the bore 172 of the base block 170, the shank 296 is inserted into the bore 172 of the base block 170 until the back flange 98 seats on the front face 178 of the base block 170. The slot 298 allows the shank 296 to radially compress when inserted into the base block bore 172 of the shortened receiving portion 176 forming an interference fit between the shank 296 and the base block bore 172. The force between the diametrically contracted shank 296 and the base block bore 172 maintains and retains the unitary bit/holder 290 in the base block 170. The unitary bit/holder 290 and the base block 170 are assembled together to form a bit assembly 302, as shown in FIG. 25.

Figure 26:
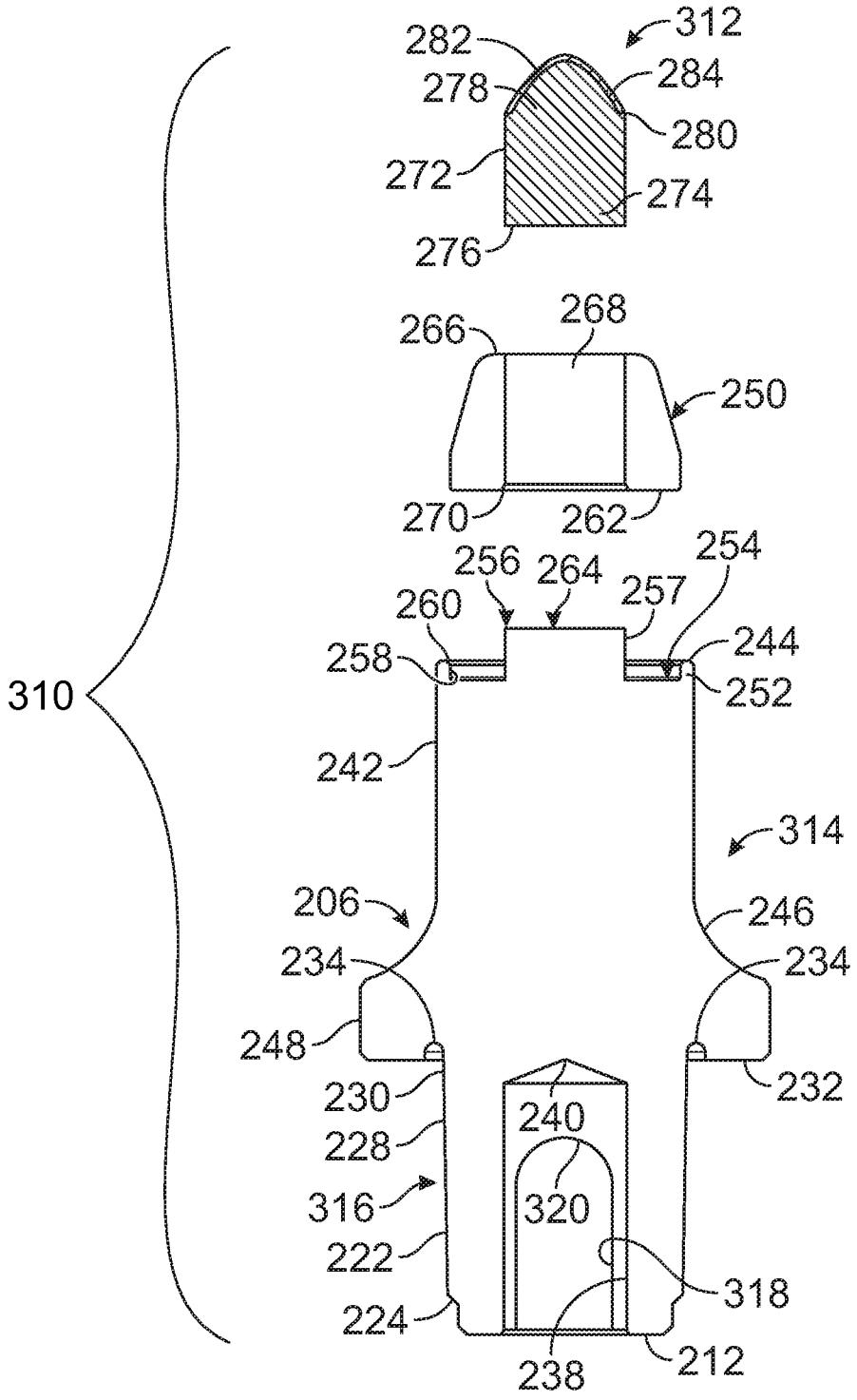
FIG. 26 is an exploded elevation view of a fifth embodiment of a combination diamond coated bit/holder, shown with the first embodiment of the bit tip insert, in accordance with implementations of this disclosure.
Figure 27:
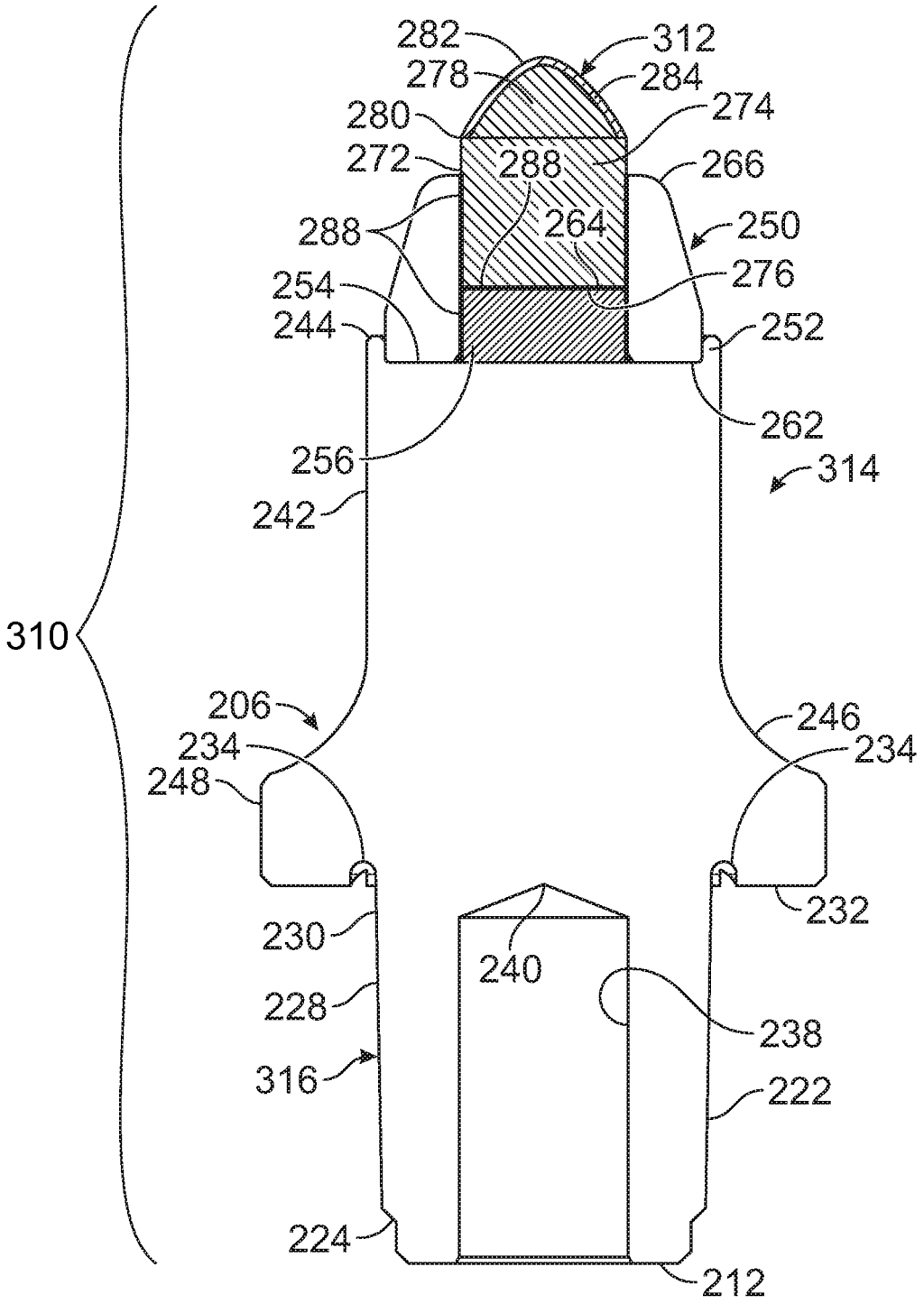
FIG. 27 is an elevation view of the fifth embodiment of the combination diamond coated bit/holder, shown assembled into unitary construction, in accordance with implementations of this disclosure.

Referring to FIGS. 26 and 27, a fifth embodiment of a combination diamond coated bit/holder 310 of the present disclosure is shown. The bit/holder 310 is a unitary bit 312 and bit holder 314 construction. The bit tip insert 312 can be of any height and/or length. The bit/holder 310 of the fifth embodiment is substantially the same as the bit/holder 200 of the third embodiment with an exception that the bit holder 314 includes a shank 316 that is shorter than the standard 2¾ inch length shank of a standard bit holder in which, in this exemplary implementation, the length of the shank 316 of the bit holder 314 is approximately a nominal 1¾ inches. Another difference between the bit/holder 310 of the fifth embodiment and the bit/holder 200 of the third embodiment is that the shank 316 of the bit holder 314, in this exemplary implementation, includes only an elongate wider first slot 318 extending from the generally annular distal end 212 of the shank 316 axially upward or forward to an upper termination 320 adjacent the upper or forward end of the shank 316. In another embodiment, the shank 316 can include an internally oriented second slot as described in the third embodiment of the bit/holder 200.

To assemble the fifth embodiment of the bit/holder 310 into a unitary structure, the tungsten carbide member 250 is positioned around the forward extension 256, which contains a brazing material, and the base portion 274 of the bit tip insert 312 is positioned in the bore 268, which contains a brazing material, of the tungsten carbide member 250, such that the distal end 276 of the bit tip insert 312 rests on the top 264 of the forward extension 256. The bit tip insert 312 and the base 262 of the tungsten carbide member 250 are brazed in in a single brazing process. The annular trough 254, the annular collar 252, the forward extension 256, and the forward end 244 of the upper body portion 242, which in this embodiment are made of steel, provide for greater expansion during the brazing process. The annular trough 254, the annular collar 252, the forward extension 256, and the forward end 244 of the upper body portion 242 and the braze material will expand more than the tungsten carbide member 250 and the base portion 274 of the bit tip insert 202 at the same brazing temperature, thereby providing a greater compression force and holding the bit tip insert 202 more securely and firmly.

To assemble the unitary bit/holder 310 in the bore 172 of the base block 170, the shank 316 is inserted into the bore 172 of the base block 170 until the back flange 232 seats on the front face 178 of the base block 170. The slot 318 allows the shank 316 to radially compress when inserted into the base block bore 172 of the shortened receiving portion 176 forming an interference fit between the shank 316 and the base block bore 172. The force between the diametrically contracted shank 316 and the base block bore 172 maintains and retains the unitary bit/holder 310 in the base block 170. The unitary bit/holder 310 and the base block 170 are assembled together to form a bit assembly 322 (not shown).

Base block 170 can be used interchangeably with any bit/holder or bit holder having a standard length shank or a shorter length shank, such as the bit/holder 70, bit/holder 200, bit/holder 290, and bit/holder 310. The receiving portion 176 and bore 172 maintain and retain the shorter length shank bit/holder within the base block 170 while the combination of the receiving portion 176, bore 172, and arcuate segment 190 maintain and retain the standard length shank bit/holder within the base block 170.

Figure 30:
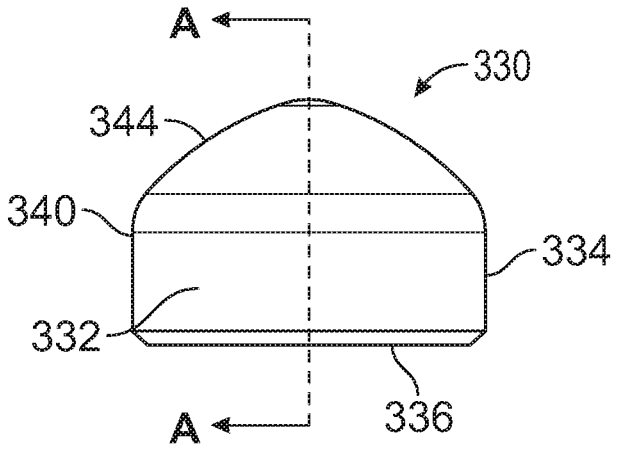
FIG. 30 is a side elevation view of a second embodiment of a bit tip insert in accordance with implementations of this disclosure.
Figure 31:
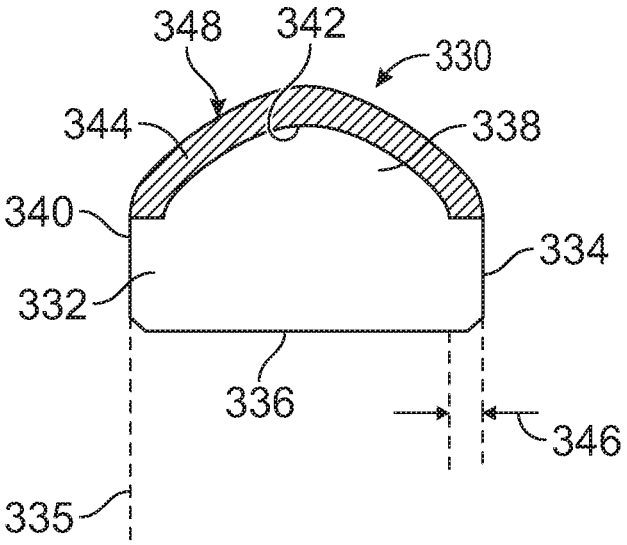
FIG. 31 is a cross-sectional view of the second embodiment of the bit tip insert, taken along line A-A of FIG. 30, in accordance with implementations of this disclosure.

Referring to FIGS. 30 and 31, a second embodiment of a bit tip insert 330 of the present disclosure is shown. The bit tip insert 330 can be used with any combination diamond coated bit/holder, as described above, or a bit holder used with a diamond coated bit tip insert. The bit tip insert 330 comprises a base portion 332, formed by punches and dies, that includes a generally cylindrical outer surface 334. In other embodiments, the outer surface can also have a declining taper or a slight draw or draft angle. In one exemplary implementation of the second embodiment, the tip insert 330 can have a diameter in the range of ⅝ inch to 1¼ inch. In this second embodiment, the base portion 332 extends to a flat distal end 336 of the tip insert 330. In other embodiments, the distal end 336 can have various shapes that correspond and/or are complementary to the top 264 (FIG. 27) of the forward extension 256. The base portion 332 may be made of steel, tungsten carbide, brass, or other similar materials and includes a tip 338 at an outer or forward end 340 of the base portion 332. The base portion 332, in this illustrated embodiment, is made of tungsten carbide which has a compression strength of 400,000-500,000 PSI. The bit tip insert 330 can be of any height and/or length. The tip 338 can have a frustoconical shape, a flat generally cylindrical puck shape, a parabolic ballistic shape, and/or an arcuate shape. In this exemplary implementation, the bit tip insert 330 is generally conical and includes a parabolic curved section below an apex of the tip insert 330. As mentioned previously with regards to the previous embodiments, the upper body portion of the bit holder, which in these embodiments are made of steel, provides for greater expansion during the brazing process. The upper body portion of the bit holder and the braze material will expand more than the tungsten carbide member and the base portion 332 of the bit tip insert 330 at the same brazing temperature, thereby providing a greater compression force and holding the bit tip insert 330 more securely and firmly.

In this second embodiment, an outer surface or forward end 342 of the tip 338 is inset from the outer diameter 335 of the outer surface 334 of the base portion 332 by removing a portion of the outer surface 342 of the tip 338 and/or a portion of the base portion 332. The base portion 332 is placed in a can that allows the base portion 332 to be positioned laterally, radially, and axially such that the inner diameter of the can fits snuggly around the outer diameter 335 of the base portion 332. The base portion 332 then has the can material removed by a physical means, such as a grinding process, in order to allow the outer diameter 335 of the base portion 332 to be brazable. The inset 346, which is formed in the tooling to make the base portion 332 with a die, and punches, and then hipped (hot isostatic pressed), provides space on the outer surface 342 of the tip 338 for an overlay 344 of a polycrystalline diamond (PCD) structure forming a PDC table 348. The PCD materials are formed onto the outer surface 342 of the tip 338 in layers to achieve the configuration and/or thickness needed of the PCD table 348. The inset 346 may eliminate the need for grinding the PCD table 348 so that the PCD table 348 does not exceed the outer diameter 335 of the base portion 332. In other embodiments, the PCD table 348 has an outer diameter at its widest portion that is at least the outer diameter 335 of the base portion 332. The base portion 332 supports and prevents the PDC table 348 from bending, allowing the PDC table 348 to take higher impact stresses and still survive. The inset 346 provides greater strength in the lower angle portion of the tip 338 where the drag-through forces in the cut can create the greatest cutting forces. The inset 346 provides added diamond and/or overlay 344 thickness, which provides greater compression support due to diamond having a compression strength of 1,000,000 PSI.

The outer surface 342 of the tip 338 may also include an overlay 344 of an industrial diamond material and may comprise a single coating or outer layer or multiple coatings or outer layers of such industrial diamond material, natural diamond, polycrystalline diamond material, polycrystalline diamond composite or compact material, and/or thermally stable polycrystalline (TSP) diamond. Additional fusing additives, such as cobalt, are used to enhance the connective fusion and bonding of the diamond particles together. The coating(s) and/or layer(s) may have different amounts of diamond material and fusing additives. For example, in an exemplary implementation, the bit tip insert 330 may include a first coating and/or layer, adjacent to the outer surface 342 of the tip 338, that comprises 30% diamond material and 70% fusing additive to provide a better bond to the outer surface 342 of the tip 338, a second coating and/or layer, adjacent the first coating and/or layer, that comprises 50% diamond material and 50% fusing additive, and a third coating and/or layer, adjacent the second coating and/or layer, that comprises 90-95% diamond material and 5-10% fusing additive. The single or multiple coatings or layers may be formed by a high pressure, high temperature process. The overlay 344 occupies a large radial and axial profile of the tip 338 which allows faster heat transfer into a region subjacent to the overlay 344 PCD layer. Excessively high heat, such as temperatures above 1300 degrees F., is the greatest cause of PCD failure due to the diamond connective failure. The quick heat transfer from the tip 338 of the PCD cutting zone, which is generally less than ½ inch depth of cut per tip engagement, to the subjacent region below the PCD drastically reduces the possibility of a temperature of the tip of the PCD table 348 reaching temperatures at or above 1300 degrees F. for any extended period of time, thereby avoiding failure of the PCD layer.

Due to the nature that the bit tip insert 330 engages on the roadway, for example, the frontal portion if the PCD table 348 of the tip 338 engages initially. As the machine moves forward, the drum of the machine generally rotates in an upward direction such that the bottom side of the bit tip insert 330 will engage the cutting action and at that time the base portion of the PCD table 348 will engage with a very high concentrated force because the bottom outside diameter of the PCD table 348 near the forward end 340 of the base portion 332 generally has the least thickness of the PCD table 348. The outer diameter of the PCD table 348 does not exceed the outer diameter 335 of the base portion 332, which attempts to equalize the diamond layers and eliminates the need to grind excess diamond material of the PCD table 348 adjacent the forward end 340 of the base portion 332.

As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, "X includes at least one of A and B" is intended to mean any of the natural inclusive permutations. That is, if X includes A; X includes B; or X includes both A and B, then "X includes at least one of A and B" is satisfied under any of the foregoing instances. The articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment, aspect or implementation unless described as such.

While the present disclosure has been described in connection with certain embodiments and measurements, it is to be understood that the present disclosure is not to be limited to the disclosed embodiments and measurements but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit assembly comprising:

a tool comprising:

a body comprising an annular recess axially extending inwardly from a forward end of the body and a solid forward extension axially extending outwardly from the annular recess;

a shank extending axially from a bottom of the body; and a transition member comprising a bore axially extending from a top of the transition member to a distal end of the transition member, the solid forward extension extending partially through the bore, and the distal end of the transition member adapted to be seated and brazed in the recess of the body; and a base block comprising:

a base mounting portion including a base surface;

a device receiving portion integrally extending from the base mounting portion opposite the base surface; and a base block bore extending through the device receiving portion, the base block bore adapted to receive the shank of the tool.

2. A bit assembly comprising:

a tool comprising:

a body comprising an annular recess axially extending inwardly from a forward end of the body and a forward extension axially extending outwardly from the annular recess;

a shank extending axially from a bottom of the body; and a transition member comprising a bore axially extending from a top of the transition member to a distal end of the transition member, the forward extension extending partially through the bore, and the distal end of the transition member adapted to be seated and brazed in the recess of the body; and a base block comprising:

a base mounting portion including a base surface;

a device receiving portion integrally extending from the base mounting portion opposite the base surface; and a base block bore extending through the device receiving portion, the base block bore adapted to receive the shank of the tool; and a bit tip insert comprising a tip, a base portion subjacent the tip, and a distal end opposite the tip, the distal end seated on a top of the forward extension, the bit tip insert adapted to be brazed in the bore of the transition member and the top of the forward extension.

3. The bit assembly of claim 2, further comprising:

braze material that attaches to the bore of the transition member, the top of the forward extension, an outer surface of the base portion of the bit tip insert, and the distal end of the bit tip insert when the bit tip insert is seated on the top of the forward extension and brazed in the bore of the transition member.

4. The bit assembly of claim 2, further comprising:

an overlay applied to an outer surface of the tip of the bit tip insert, the overlay comprising at least one of:

at least one coating of at least one of industrial diamond, natural diamond, polycrystalline diamond (PCD), PCD diamond composite, and thermally stable polycrystalline diamond; and at least one layer of at least one of industrial diamond, natural diamond, polycrystalline diamond (PCD), PCD diamond composite, and thermally stable polycrystalline diamond.

5. The bit assembly of claim 1, further comprising:

a length of the shank comprising one of a standard length and a shortened length, the standard length being a nominal 2¾ inch, and the shortened length being shorter than the standard length.

6. The bit assembly of claim 5, the shortened length being a nominal 1¾ inches.

7. The bit assembly of claim 1, further comprising:

a slot extending axially upward from a shank distal end of the shank to an upper termination.

8. The bit assembly of claim 7, wherein the upper termination is disposed adjacent a shank forward end of the shank.

9. The bit assembly of claim 1, further comprising:

an axial length of the device receiving portion that is shorter than a length of the base mounting portion.

10. The bit assembly of claim 9, the base mounting portion comprising an extension of an arcuate segment of the base block bore extending past a rear of the device receiving portion to a location adjacent a rear of the base mounting portion.

11. A bit assembly comprising:

a tool comprising:

a body comprising an annular recess axially extending inwardly from a forward end of the body and a forward extension axially extending outwardly from the annular recess;

a shank extending axially from a bottom of the body; and a transition member comprising a bore axially extending from a top of the transition member to a distal end of the transition member, the forward extension extending partially through the bore, and the distal end of the transition member adapted to be seated and brazed in the recess of the body; and a base block comprising:

a base mounting portion including a base surface;

a device receiving portion integrally extending from the base mounting portion opposite the base surface, an axial length of the device receiving portion shorter than a length of the base mounting portion; and a base block bore extending through the device receiving portion, the base block bore adapted to receive the shank of the tool; and an angular slot extending inwardly from a rear of the device receiving portion, the angular slot enclosed within a sidewall of the device receiving portion and decreasing radially in size from the rear of the device receiving portion to a position mediate a front of the device receiving portion and the rear of the device receiving portion.

12. The bit assembly of claim 1, wherein the device receiving portion comprises at least one of an annular shape and a circular shape, the annular shape and the circular shape including one of arcuate sides and a pair of opposed flat sides.

* * * * *